US012570385B2

(12) United States Patent
Taylor et al.

(10) Patent No.: US 12,570,385 B2
(45) Date of Patent: Mar. 10, 2026

(54) ELECTRIC MARINE PROPULSION SYSTEM AND POWER CONTROL METHOD

(71) Applicant: Brunswick Corporation, Mettawa, IL (US)

(72) Inventors: Brad E. Taylor, Stillwater, OK (US); Alexander G. Province, Fond du Lac, WI (US); Aleksandar Lazarov, Rotterdam (NL); Jacob Hendrik Ritskes, Lemmer (NL)

(73) Assignee: Brunswick Corporation, Mettawa, IL (US)

( * ) Notice: Subject to any disclaimer, the term of this patent is extended or adjusted under 35 U.S.C. 154(b) by 595 days.

(21) Appl. No.: 18/054,804

(22) Filed: Nov. 11, 2022

(65) Prior Publication Data

US 2024/0158064 A1 May 16, 2024

(51) Int. Cl.
*B63H 21/17* (2006.01)
*B63H 21/21* (2006.01)

(52) U.S. Cl.
CPC ..... *B63H 21/17* (2013.01); *B63H 21/21* (2013.01); *B63H 2021/216* (2013.01)

(58) Field of Classification Search
CPC ... B63H 21/17; B63H 21/21; B63H 2021/216
See application file for complete search history.

(56) References Cited

U.S. PATENT DOCUMENTS 6,507,164 B1 1/2003 Healey et al.
6,902,446 B1 6/2005 Healey
7,104,856 B1 9/2006 Krupp et al.
8,043,132 B1 10/2011 Wyant
8,944,865 B1 2/2015 Krabacher et al.
10,017,136 B1 7/2018 Waisanen et al.
10,202,180 B1 2/2019 Amerling et al.
(Continued)

FOREIGN PATENT DOCUMENTS

WO 2021216912 10/2021

OTHER PUBLICATIONS

Park et al., "Outboard Motor," U.S. Appl. No. 29/848,875, filed Aug. 5, 2022 (drawings, specification, and claims only).
(Continued)

*Primary Examiner* — Stephen P Avila
(74) *Attorney, Agent, or Firm* — Andrus Intellectual Property Law, LLP

(57) ABSTRACT

A marine propulsion system includes a marine drive having an electric motor powerhead, at least one marine battery, at least a first connection cable having a connector configured to removably connect to a drive port on a housing of the marine drive, and an interlock circuit. The interlock circuit is configured to provide a completed circuit when the at least one battery and the marine drive are connected via at least the first connection cable, wherein the interlock circuit is independent from a power circuit delivering power from the at least one marine battery to the marine drive. The at least one battery is configured to identify whether the interlock circuit is completed and to control an internal disconnect to connect to the power circuit when the interlock circuit is completed and to disconnect from the power circuit when the interlock circuit is opened.

24 Claims, 22 Drawing Sheets

(56) References Cited

U.S. PATENT DOCUMENTS

| | | | | |
|---|---|---|---|---|
| 10,511,121 | B2 | 12/2019 | Milroy et al. | |
| 10,710,691 | B2 | 7/2020 | Amerling et al. | |
| 11,046,405 | B1 | 6/2021 | Groeschel et al. | |
| 11,377,186 | B1 | 7/2022 | Ahlswede et al. | |
| 2003/0057849 | A1* | 3/2003 | Pruett ..... | H05B 41/2925 315/119 |
| 2021/0234402 | A1 | 7/2021 | Sultenfuss et al. | |
| 2022/0194542 | A1 | 6/2022 | Kirchhoff et al. | |
| 2022/0200070 | A1 | 6/2022 | Gonring | |
| 2022/0328912 | A1 | 10/2022 | Gonring | |

OTHER PUBLICATIONS

Johnson et al., "Battery," U.S. Appl. No. 29/855,548, filed Oct. 4, 2022 (drawings, specification, and claims only).

Amphenol Sine Systems, AHDP04-24-09PR-SRA, product data sheet, May 8, 2020, available at https://www.amphenol-sine.com/pdf/datasheet/AHDP04-24-09PR-SRA.pdf.

Amphenol Sine Systems, AHDP06-24-09PR-SRA, product data sheet, May 12, 2020, available at https://www.amphenol-sine.com/pdf/datasheet/AHDP06-24-09PR-SRA.pdf.

Amphenol Sine Systems, AHDP06-24-09SR-SRA, product data sheet, May 12, 2020, available at https://www.amphenol-sine.com/pdf/datasheet/AHDP06-24-09SR-SRA.pdf.

Amphenol Sine Systems, AHDP04-24-09SR-SRA, product data sheet, May 8, 2020, available at https://www.amphenol-sine.com/pdf/datasheet/AHDP04-24-09SR-SRA.pdf.

Amphenol Sine Systems, AHDP02-24-07PN-WTACL22, product data sheet, Sep. 1, 2020, available at https:/www.amphenol-sine.com/pdf/datasheet/AHDP02-24-07PN-WTACL22.pdf.

Amphenol Sine Systems, AHDP06-24-07SN-SRACL22, product data sheet, May 8, 2020, available at https://www.amphenol-sine.com/pdf/datasheet/AHDP06-24-07SN-SRACL22.pdf.

Amphenol Sine Systems, AHDP04-24-07PN-WTACL22, product data sheet, Jul. 6, 2019, available at https://www.amphenol-sine.com/pdf/datasheet/AHDP04-24-07PN-WTACL22.pdf.

Fergus et al., U.S. Appl. No. 17/487,116, filed Sep. 28, 2021, "Outboard Motor That Is Removable From Transom Clamp Bracket" (specification, claims, and drawings only).

Schrank et al., U.S. Appl. No. 17/509,739, filed Oct. 25, 2021, "Integrated Copilot and Locking Mechanism for Marine Drives" (specification, claims, and drawings only).

Nickols et al., U.S. Appl. No. 17/884,355, filed Aug. 9, 2022, "Transom Bracket Assemblies for Supporting a Marine Drive on a Vessel" (specification, claims, and drawings only).

Kalnins et al., U.S. Appl. No. 17/695,200, filed Mar. 15, 2022, "Electric Marine Propulsion System and Control Method" (specification, claims, and drawings only).

Park et al., U.S. Appl. No. 29/848,875, filed Aug. 5, 2022, "Outboard Motor" (specification, claim, and drawings only).

Johnson et al., U.S. Appl. No. 29/855,548, filed Oct. 4, 2022, "Battery" (specification, claims, and drawings only).

Fletcher, U.S. Appl. No. 17/939,474, filed Sep. 7, 2022, "Marine Drives and Apparatuses for Steering Marine Drives and for Routing Flexible Rigging Connectors on Marine Drives" (specification, claims, and drawings only).

McEathron et al., U.S. Appl. No. 17/972,691, filed Oct. 25, 2022, "Marine Drives and Apparatuses for Steering Marine Drives and for Routing Flexible Rigging Connectors on Marine Drives" (specification, claims, and drawings only).

Amphenol Sine Systems, AHDP04-24-08PN-M1WTA, product data sheet, Sep. 22, 2021.

Amphenol Sine Systems, AHDP06-24-08SN-M1WTA, product data sheet, Sep. 22, 2021.

Amphenol Sine Systems, AHDP02-24-08PN-M1SRA, product data sheet, Sep. 22, 2021.

Extended European Search Report in corresponding EP Application 23209266.8, mailed on Aug. 5, 2024.

* cited by examiner

ELECTRIC MARINE PROPULSION SYSTEM AND POWER CONTROL METHOD

FIELD

The present disclosure generally relates to marine propulsions systems, and more particularly to electric marine propulsion systems having electric motors and methods for controlling and scaling power utilization thereof.

BACKGROUND

Electric propulsion systems comprising an electric marine drive having an electric motor rotating a propeller are known. For example, in-board electric marine drive systems and outboard electric marine drive systems have been developed for propelling marine vessels. Different power supply arrangements for powering electric propulsion systems are also known. Such power storage systems include one or more batteries or banks of batteries.

The following U.S. Patents and Applications provide background information and are each incorporated herein by reference in entirety.

U.S. Pat. No. 6,507,164 discloses a trolling motor having current-based power management including: an electric motor; a motor controller having an output for providing voltage to the motor; and a current sensor for measuring the electrical current flowing through the motor. Upon determining that the trolling motor has been operating above its continuous duty limit for a predetermined period of time, the motor controller begins reducing the voltage output to the motor until reaching an acceptable output voltage. In another embodiment, the controller is operated in three distinct modes with three distinct sets of operating parameters, namely: a normal mode wherein the output is set to a commanded level; a current limit mode wherein the output is set to a safe, predetermined level; and a transitional mode wherein the output is incrementally changed from the predetermined level to the commanded level.

U.S. Pat. No. 6,902,446 discloses a DC motor having a motor housing and a motor controller housed within the motor housing. In a preferred embodiment the heat-producing components of the motor controller are in thermal communication with the housing such that the majority of the heat produced by such components will be readily conducted to the environment in which the motor is operating. When incorporated into a trolling motor, the motor housing of the present invention will be submerged so that controller-produced heat will be dissipated into the water in which the trolling motor is operated.

U.S. Pat. No. 11,377,186 discloses an apparatus for operably connecting a marine drive to a marine vessel. A transom bracket is configured for fixed attachment to the marine vessel and for attachment to the marine drive such that the marine drive is trimmable up and down relative to the marine vessel about a trim axis. The transom bracket has a sidewall with a rigging opening through which at least one elongated rigging member extends for operably connecting the marine drive to the marine vessel, wherein the rigging opening is located along the trim axis. The rigging device has an elbow conduit with an inlet end and an outlet end, wherein the outlet end is positionable into a plurality of clock positions relative to the inlet end.

U.S. Publication No. 2022/0194542 discloses a method of controlling an electric marine propulsion system configured to propel a marine vessel including measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

U.S. Publication No. 2022/0328912 discloses a marine battery system configured to provide energy to a marine vessel load. The marine battery system includes a main enclosure body and an auxiliary enclosure body that is detachably coupled to the main enclosure body to define a sealed battery volume. The auxiliary enclosure body is configured to perform a pressure accommodation action responsive to an increase in a temperature within the sealed battery volume. The marine battery system further includes a battery disposed within the sealed battery volume.

U.S. Publication No. 2022/0200070 discloses a marine battery system configured to provide energy to a marine vehicle load is provided. The marine battery system includes a battery, an enclosure configured to at least partially encapsulate the battery, a temperature sensor configured to detect temperature information within the enclosure, a pressure sensor configured to detect pressure information within the enclosure, and a controller coupled to the temperature sensor and the pressure sensor. The controller is configured to receive the temperature information from the temperature sensor, receive the pressure information from the pressure sensor, determine whether an enclosure breach condition has occurred based on a comparison of the temperature information and the pressure information, and in response to a determination that the enclosure breach condition has occurred, perform an enclosure breach mitigation action.

U.S. patent application Ser. No. 17/487,116, filed Sep. 28, 2021, discloses an outboard motor having a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739, filed Oct. 25, 2021, discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly such that in a locked position the marine drive is retained on the transom bracket assembly and such that in an unlocked position the marine drive is removable from the transom bracket assembly.

U.S. patent application Ser. No. 17/884,355, filed Aug. 9, 2022, discloses a transom bracket assembly for supporting a marine drive on a marine vessel. The assembly comprises a transom bracket comprising a swivel cylinder, a steering arm extending from the marine drive, a swivel tube having a first end coupled to the steering arm and a second end seated in the swivel cylinder so that steering of the steering arm relative to the transom bracket rotates the swivel tube in the swivel cylinder about a steering axis for the marine drive, and a yoke which couples the second end of the swivel tube to the marine drive.

U.S. patent application Ser. No. 17/695,200, filed Mar. 15, 2022, discloses an electric marine propulsion system configured to propel a marine vessel includes a power storage system comprising a plurality of batteries and at least one electric motor powered by the power storage system and configured to rotate a propulsor to propel the marine vessel. A control system is configured to identify a charge level for each of the plurality of batteries and determine which of the plurality of batteries are active batteries based at least in part on the charge level on each of the plurality of batteries. A minimum power limit is then identified for the active batteries and a system power limit is determined based on the minimum power limit and the number of active batteries. The at least one electric motor is then controlled based on the system power limit such that the system power limit is not exceeded.

U.S. patent application Ser. No. 29/848,875, filed on Aug. 5, 2022, discloses an ornamental design for an outboard motor.

U.S. patent application Ser. No. 29/855,548, filed on Oct. 4, 2022, discloses an ornamental design for a battery.

U.S. patent application Ser. No. 17/939,474, filed Sep. 7, 2022, discloses a marine drive including a frame configured to support the marine drive with respect to the marine vessel, a cowling enclosing a portion of the frame in a cowling interior, a steering arm configured such that movement of the steering arm causes rotation of the marine drive with respect to the steering axis, and a flexible rigging connector extending from the cowling interior to a location in the marine vessel. The flexible rigging connector may extend through a guide passage in the steering arm. Additionally or alternatively, the steering arm may include a base member and a mounting member selectively movable relative to the base member to adjust the length of the steering arm.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect of the present disclosure, a marine propulsion system includes a marine drive having an electric motor powerhead, at least one marine battery, at least a first connection cable having a connector configured to removably connect to a drive port on a housing of the marine drive, and an interlock circuit. The interlock circuit is configured to provide a completed circuit when the at least one battery and the marine drive are connected via at least the first connection cable, wherein the interlock circuit is independent from a power circuit delivering power from the at least one marine battery to the marine drive. The at least one battery is configured to identify whether the interlock circuit is completed and to control an internal disconnect to connect to the power circuit when the interlock circuit is completed and to disconnect from the power circuit when the interlock circuit is opened.

In one example, the at least one battery is configured to measure a resistance of the interlock circuit, and wherein identifying whether the interlock circuit is completed includes determining whether the resistance of the interlock circuit is less than a predetermined low resistance.

In another example, the first connection cable is configured to removably connect between the drive port on the marine drive and a battery port on a housing of the at least one marine battery to connect the power circuit and the interlock circuit between the marine drive and the at least one marine battery.

In another example, the connector includes two interlock circuit terminals and two power circuit terminals.

In another example, the system further includes a switch box removably connectable to the marine drive and to each of at least two marine batteries, wherein the interlock circuit is configured to provide the completed circuit when at least one of the at least two marine batteries and the marine drive are connected to the marine drive through the switch box.

In another example, the system further includes a switch box having a user-controlled switch operable by a user to connect and disconnect the power circuit and/or the interlock circuit. Optionally, the user-controlled switch is configured to connect and disconnect each of the power circuit and the interlock circuit, simultaneously.

In another example, the system further includes a switch box configured to connect to a battery charger and to deliver a charge current to each of the at least two marine batteries when the battery charger is connected.

In another example, the system further includes a switch box configured to deliver power from each of the at least two marine batteries in parallel, and wherein a subset of the at least two marine batteries can be disconnected from the switch box without disconnecting the power circuit or opening the interlock circuit to the remaining marine batteries.

In a further example, the system includes at least three connection cables, wherein the first connection cable is configured to connect the power circuit and the interlock circuit from the switch box to the marine drive. A second connection cable is configured to connect the power circuit and the interlock circuit from the switch box to a first battery of the at least two marine batteries and a third connection cable is configured to connect the power circuit and the interlock circuit from the switch box to a second battery of the at least two marine batteries. Each connection cable includes a first connector configured to connect to the switch box and a second connector configured to connect to one of the marine drive, the first battery, and the second battery. Each of the first and second connectors includes two interlock circuit terminals and two power circuit terminals. Optionally, each of the switch box and the at least two marine batteries is portable such that it is configured to be disconnected from the system by disconnecting each of the first connection cable, second connection cable, and third connection cable, and carried on and off of a marine vessel.

In a further example, each of the at least two marine batteries is configured to measure a resistance of the interlock circuit across the two interlock circuit terminals in the second connector connected thereto, and wherein identifying whether the interlock circuit is completed includes determining whether the resistance of the interlock circuit is less than a predetermined low resistance.

In another example, the system further includes a battery charger configured to connect to the interlock circuit and to connect a predefined charge indicator resistance to the interlock circuit. Each of the at least two marine batteries is configured measure a resistance of the interlock circuit and, if the measured resistance is within a threshold range including the predefined charge indicator resistance, switch to a charging mode to receive the charge current from the battery charger.

In another aspect of the present disclosure, a power control system for controlling a power circuit of an electric marine propulsion system, wherein the power circuit delivers power from at least one marine battery to a marine drive, includes an interlock circuit and a battery controller in in each of the at least one battery. The interlock circuit includes a drive circuit portion connecting to the marine drive and at least one battery circuit portion, each battery circuit portion connecting to a respective one of the at least one marine battery. The interlock circuit is configured to provide a completed circuit independent from the power circuit that includes the drive circuit portion and the at least one battery circuit portion when the marine drive and the at least one battery are connected. The battery controller in each of the at least one battery is configured to identify whether the interlock circuit is completed and to control an internal disconnect to connect to the power circuit when the interlock circuit is completed and to disconnect from the power circuit when the interlock circuit is open.

In one example, each of the at least one battery is configured to measure a resistance of the interlock circuit, and wherein each battery controller is configured to identify whether the interlock circuit is completed by determining whether the measured resistance of the interlock circuit is less than a predetermined low resistance.

In another example, the interlock circuit is configured to enable connection of a plurality of battery circuit portions each connecting to one of a plurality of marine batteries, and to enable removal of a subset of the plurality of battery circuit portions without opening the interlock circuit for at least one remaining battery circuit portion in the plurality of battery circuit portions.

In another example, a switch box is configured to complete the power circuit and the interlock circuit between each of a plurality of marine batteries in parallel and the marine drive so as to power the marine drive, wherein the switch box includes a user-controlled switch operable to simultaneously connect and disconnect the power circuit and the interlock circuit.

In another example, the system includes a switch box and at least three connection cables, including a first connection cable containing the drive circuit portion and configured to connect the power circuit from the switch box to the marine drive, a plurality of battery connection cables each containing one of a plurality of battery circuit portions and configured to connect the power circuit from the switch box to a respective one of a plurality of marine batteries. Each battery connection cable includes a first connector configured to connect to the switch box and a second connector configured to connect to a battery port on one of the plurality of marine batteries or on the marine drive, wherein each connector includes two interlock circuit terminals and two power circuit terminals.

In one aspect of the present disclosure, a method of controlling a power circuit of electric marine propulsion system including at least one battery and a marine drive is provided. The method includes measuring a resistance of an interlock circuit, wherein the interlock circuit is configured to provide a completed circuit when the at least one battery and the marine drive are connected via at least one connection cable, wherein the interlock circuit is independent from a power circuit delivering power from the at least one marine battery to the marine drive. A mode of each marine battery is then controlled between a power delivery mode, a charge mode, and a disconnected mode based on the measured resistance of the interlock circuit.

In one example, the method includes identifying whether the interlock circuit is completed based on the measured resistance and, if the interlock circuit is completed, connecting at least one battery to a power circuit in a power delivery mode enabling delivery of power from the at least one battery to a marine drive.

In another example, the method includes identifying whether the interlock circuit is completed by determining whether the measured resistance of the interlock circuit is less than a predetermined low resistance.

In another example, the method includes measuring the resistance of the interlock circuit at two interlock circuit terminals at each of the at least one battery.

In another example, the method includes, comparing the measured resistance to one or more thresholds to determine if the interlock circuit is completed.

As a further example, if the measured resistance of the interlock circuit is less than a predetermined low resistance, operating the battery in the power delivery mode enabling power delivery to the marine drive. If the measured resistance of the interlock circuit is within a threshold charge indicator resistance range, operating the battery in the charge mode enabling power receipt from a charger. And if the measured resistance is not less than the predetermined low resistance and not within the threshold charge indicator resistance range, operating the battery in the disconnected mode where power delivery and power receipt are disabled.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
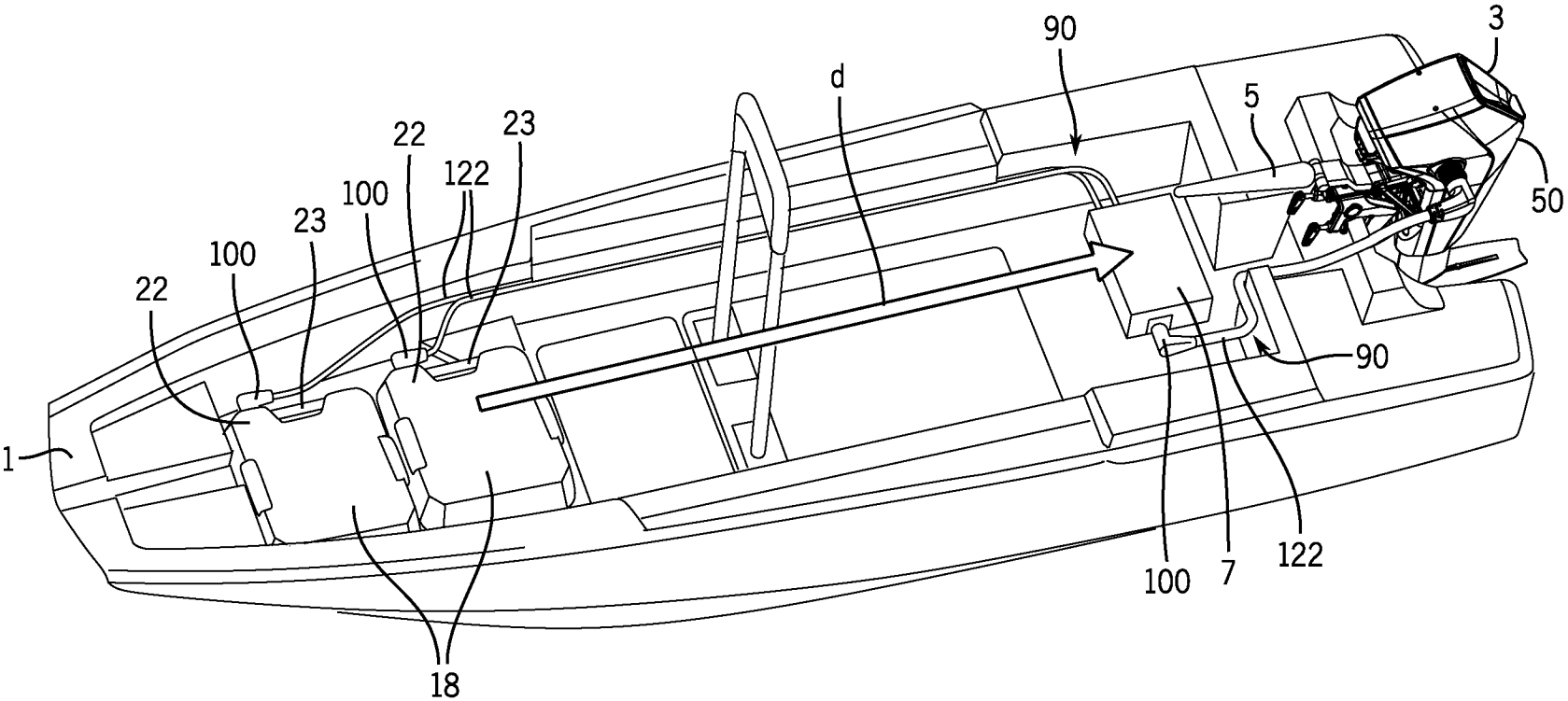
FIG. 1 illustrates a marine vessel having an electric marine propulsion system according to the present disclosure, in which an electric marine drive is controlled by a tiller.

Through extensive experimentation and research in the relevant field, the present inventors have recognized problems with existing electric marine propulsion system arrangements. Installation of existing electric propulsion systems on a marine vessel is difficult, requiring electrical expertise, particularly for systems with energy capacity needs that require external power storage devices, such as marine batteries or battery banks. Additionally, the inventors have recognized that marine environments present particular challenges for electric propulsion systems, where the constant exposure to water (particularly salt water) causes corrosion, increased chances for electrical shorts, etc. Installing water-tight and/or marine-safe electrical rigging is difficult, and current systems require dedicated rigging space for electrical connections on the marine vessel. All of this makes installation, configuration, and maintenance difficult and technical, requiring an expert technician to access the vessel.

The inventors recognized a need for a propulsion system that is modular and portable, including being configured for flexible movement and arrangement of parts around a marine vessel and for accommodating variable power storage capacity that is easily and instantaneously scaled up or down by connecting or disconnecting marine batteries into/from the system. Further, the inventors have recognized a need for an electric propulsion system that can be installed by a novice user on any small vessel, and thus which does not require complicated electrical rigging or installation and does not require dedicated or predefined spaces for rigging electrical connections. Similarly, the inventors have recognized a need for such a plug-and-play electric propulsion system that has built-in features for withstanding harsh marine environments, including water-safe electrical connections and power control that does not rely on user configuration or installation.

In view of the forgoing problems and challenges in the relevant art, the inventors developed the disclosed electric propulsion system that is easily installed on a vessel, requiring only minimal connection and disconnection of cables that provide unitary connection points for all power, data, and safety systems. As disclosed, the electric marine propulsion system is scalable, allowing easy addition and subtraction of batteries into/from the system at any time, including during operation of the electric marine drive, without interrupting power supply to the electric marine drive. Additionally, the system is scalable to add additional electric marine drives, which can be communicatively linked to provide scalable and unified propulsion output. In some disclosed embodiments, the electric marine propulsion system is portable, where each of the marine batteries, switch box, and/or electric marine drive may be configured to be carried on and off the marine vessel with ease, such as with every use.

In one embodiment, the electric marine propulsion system includes an electric marine drive having an electric motor powerhead powered by at least two marine batteries, such as a plurality of marine batteries each having a maximum operating voltage at or below 60 volts. A switch box is removably connected between the electric marine drive and to each of the at least two marine batteries so as to electrically connect each of the at least two marine batteries in parallel to the electric marine drive for powering the electric marine drive. The switch box may be configured to permit connection of one or a plurality of marine batteries up to a maximum number and may be configured to allow connection and disconnection of marine batteries while maintaining power delivery to the electric marine drive. For example, the switch box may be configured to allow connection of up to four marine batteries in parallel, wherein any subset of the four marine batteries can be connected or disconnected from the switch box without disabling or disrupting power delivery to the electric marine drive from the remaining batteries.

The switch box may include a user-controlled switch operable to centrally connect and disconnect all of marine batteries that are arranged in parallel. The switch box may also include a charging port and may be configured to deliver a charge current from a charger to all of the connected marine batteries.

Additionally, the inventors have recognized a need for an electric marine propulsion system that automatically controls a power circuit between one or more marine batteries, thereby reducing shock risk, such as for systems with voltages above the touch-safe level. Additionally, the inventors recognized a need for a power control system that automatically controls the internal connection and mode status of marine batteries without needing user input, such as without requiring a user to turn off or disconnect marine batteries individually when the propulsion system is not in use so that the marine batteries are not drained while the system is not in use for an extended period of time. At the same time, however, the inventors endeavored to develop a system that enables activation of the power circuit connection between the marine drive and the battery(ies) without having key switch or otherwise requiring the user to take separate steps to activate the system. In some embodiments, the disclosed system enables activation of the power circuit without requiring the user to carry a key to enable activation.

The inventors have further recognized a need for a power control system that enables central charging of marine batteries connected in parallel within the system, and for the marine batteries to each detect connection of the battery charger at a remote location, such as connection of the battery charger to a central switch box configured to provide multi-battery power distribution.

In view of the forgoing, the inventors developed the disclosed power control system for controlling a power circuit of an electric marine propulsion system, wherein the power circuit delivers power from at least one marine battery to a marine drive. The power control system operates via an interlock circuit, which is a smaller gauge low current circuit configured to provide a completed circuit when the at least one battery and the marine drive are connected together and that is independent from the larger gauge high current power circuit. Each of the at least one battery, such as via its respective battery controller, is configured to identify whether the interlock circuit is completed and to control an internal disconnect switch to connect to the power circuit when the interlock circuit is completed and to disconnect from the power circuit when the interlock circuit is open.

For example, each battery may be configured to measure a resistance at the interlock circuit terminals configured to connect to the interlock circuit and determine whether the interlock circuit is completed, meaning connected to the respective battery and to the marine drive, based on the resistance. If the interlock circuit is completed, then the battery controller will operate at least one internal connection to connect in a power-providing capacity to the power circuit. Conversely, if the measured resistance increases above a threshold indicating that the interlock circuit has opened, then the battery controller my disconnect from the power circuit and enter into a disconnected mode that preserves that battery.

In some embodiments, the interlock circuit is configured to accommodate any number of one or more marine batteries to provide power connection control for any number of connected marine batteries, where disconnection of one or a subset of the plurality of batteries will not interrupt the interlock circuit connection of the remaining batteries that are still connected. For example, where a plurality of batteries are involved, the interlock circuit connects through the switch box. The switch box is configured to deliver power from each of the at least two marine batteries in parallel, and wherein a subset of the batteries can be disconnected from the switch box without disconnecting the power circuit or opening the interlock circuit to the remaining batteries.

The switch box is further configured to connect to a battery charger and to deliver a charge current to each of the at least two batteries when the battery charger is connected. In one embodiment, the battery charger is configured to connect to the interlock circuit at the switch box and to connect a predefined charge indicator resistance to the interlock circuit. Each of the at least two batteries is configured measure a resistance of the interlock circuit and, if the measured resistance is within a threshold range including the predefined charge indicator resistance, switch to a charging mode to receive the charge current from the battery charger.

Figure 2:
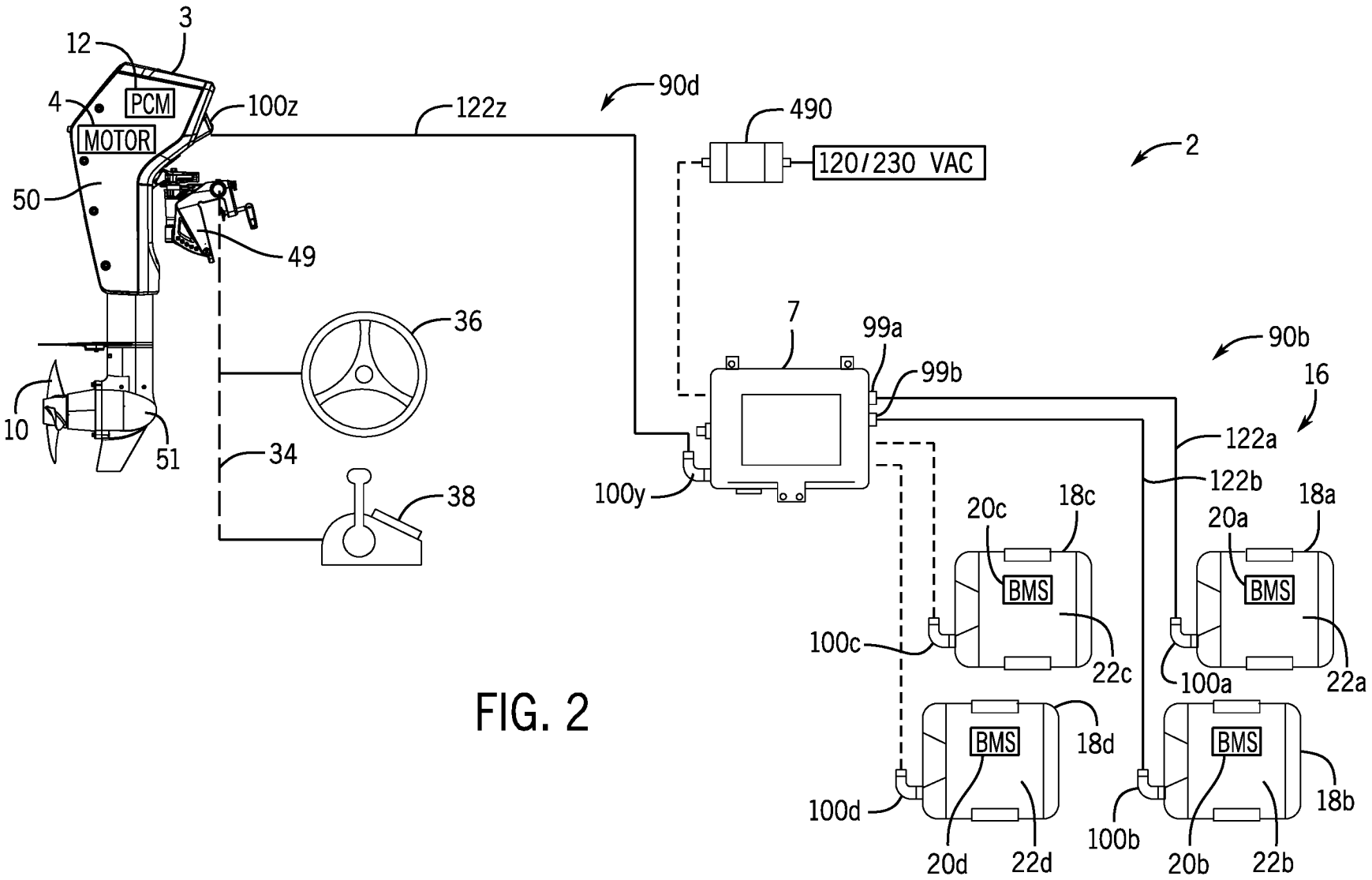
FIG. 2 is a schematic representation of another electric marine propulsion system according to the present disclosure, in which an electric marine drive is controlled at a helm.
Figure 3:
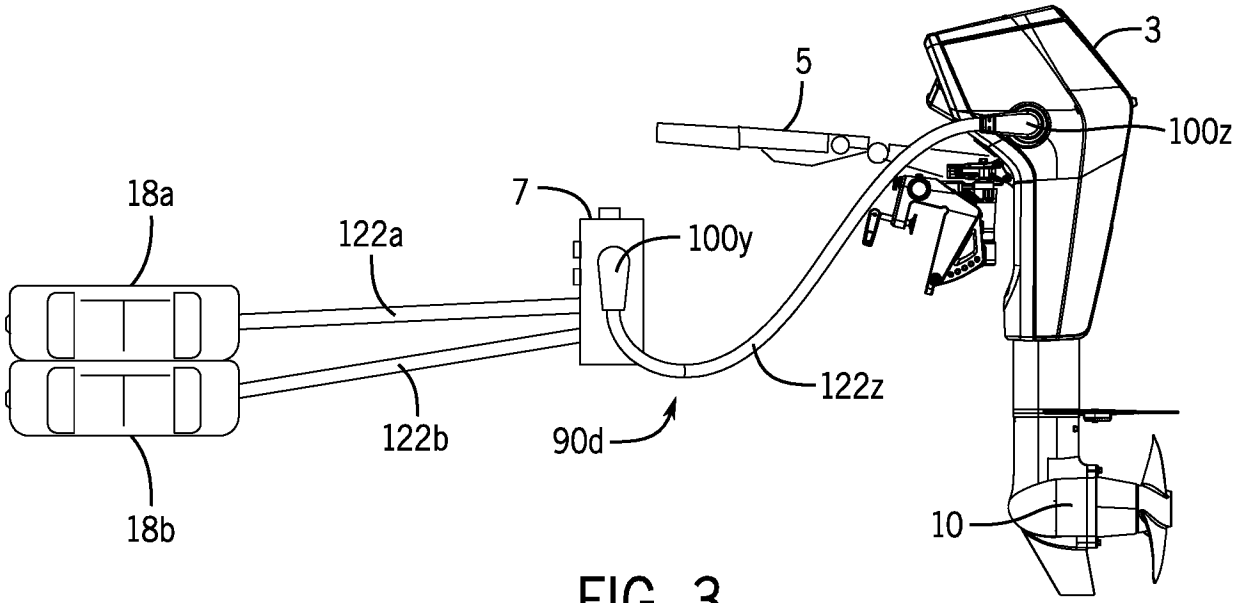
FIG. 3 illustrates an electric marine propulsion system like that of FIG. 1, in which an electric marine drive is connected to a pair of batteries by way of a switch box.
Figure 4:
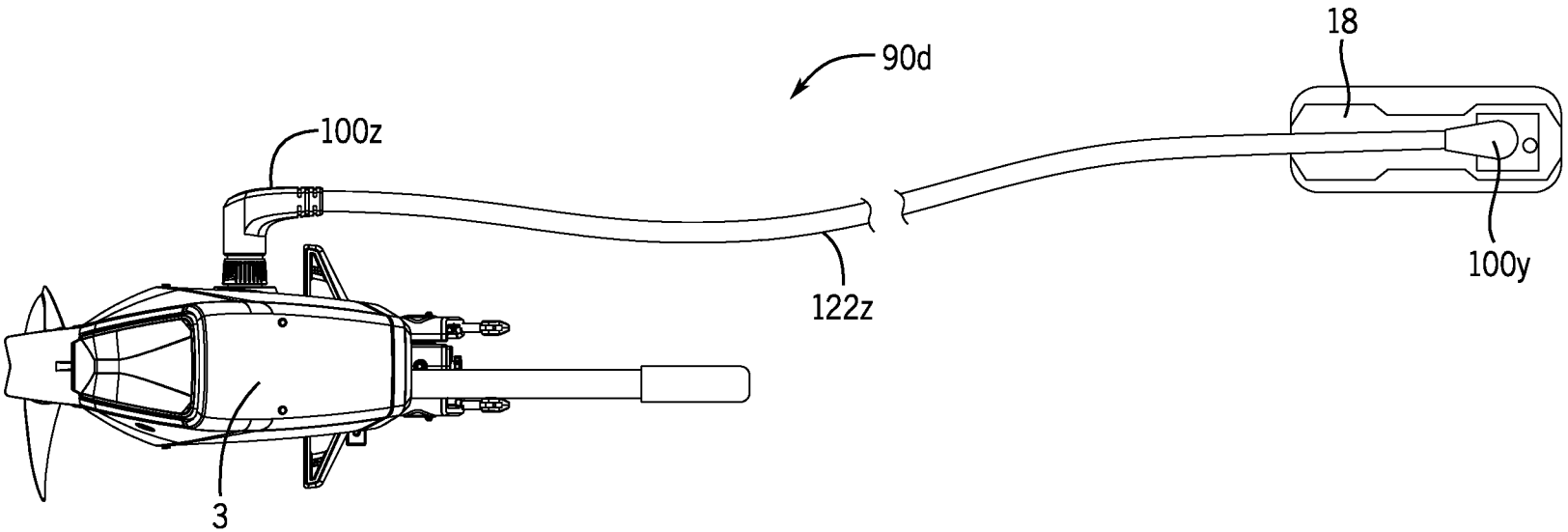
FIG. 4 illustrates yet another electric marine propulsion system according to the present disclosure, in which an electric marine drive is connected to a battery with no intervening switch box.

FIGS. 1 through 4 exemplify electric marine propulsion systems 2 in accordance with the present disclosure. Each electric marine propulsion system 2 includes an electric marine drive 3 powered by one marine battery 18 or a plurality of marine batteries 18 connected in parallel through a switch box 7. The switch box 7 enables multi-battery power distribution, as well as other safety, power control, and charging features. Any number of batteries 18 can be connected to the switch box 7 between one and the maximum number of ports on the switch box 7, which in various embodiments may be four, six, or more ports. The switch box 7 enables connection and disconnection of a plurality of marine batteries (e.g., 18*a-d*), including the addition or disconnection of a subset of marine batteries 18*a-d* without disrupting operation of the marine drive 3. The system 2 is also configured to enable direct connection of the electric marine drive 3 and a single battery 18, as shown in FIG. 4, eliminating the switch box 7 where only one battery 18 is used.

FIG. 1 depicts an exemplary embodiment of the disclosed electric marine propulsion system 2 on a marine vessel 1, which electric marine propulsion system 2 is modular and configured for quick and easy installation on a small marine vessel 1. Each marine battery 18 and the switch box 7 may be portable and configured to be easily transported on and off the marine vessel 1. Each marine battery 18 is separately housed in a marine-safe housing adapted for operation in a marine environment, including for preventing water ingress. For example, each battery housing 22 may have a handle 23 that enables easy carrying on and off the marine vessel 1. The switch box 7 is also contained in a marine-safe housing that is sealed against water ingress (see FIG. 27) and likewise may have a handle configured for easy carrying on and off the marine vessel 1.

The switch box 7 removably connects to each of the batteries 18 in parallel via connection cables 90 that each include a cable 122 with a connector 99, 100 (see FIG. 2) on each end. A connection cable 90 also connects the electric marine drive 3 to the switch box 7. Each connector 99, 100 connects to a port on the switch box 7, the battery 18, or the electric marine drive 3 to provide an all-in-one power, data, and interlock connection between the switch box 7 and each of the batteries 18 and between the switch box 7 and the electric marine drive 3. The connectors 99, 100 are twist-to-lock connectors that are easily connected and disconnected from the batteries 18, switch box 7, and electric marine drive 3 so that the system 2 is easily assembled and disassembled. Connection between the electric marine drive 3, the switch box 7, and the batteries 18 via the connection cables 90 is all that is required to install the electrical and data aspects of the electric marine propulsion system 2 on a vessel. Thus, in addition to mounting the electric marine drive 3, installing the electric marine propulsion system 2 only requires plugging in a few connectors 99, 100. The electric marine drive 3 may be connected to the marine vessel 1 via a detachable transom bracket 49, such as those shown and described in U.S. patent application Ser. Nos. 17/487,116; 17/509,739; or 17/884,335, incorporated by reference herein.

In some embodiments, the connection cable 90 comprises identical elbow connectors 100 on each end of the cable 122 and identical ports are provided on each of the battery 18, switch box 7, and/or on the electric marine drive 3, such that the connection cables 90 between the various devices are reversible (direction agnostic) and interchangeable. This maximizes flexibility and modularity of the system 2, in that the same connection cable 90 can be used two connect any two devices—i.e., between the battery 18 and the switch box 7, between the switch box 7 and the electric marine drive 3, or between the battery 18 and the electric marine drive 3.

The connection cables 90 may be available in various sizes so that a user can customize the system 2 based on their needs and the size constraints of a particular marine vessel. This enables placement of the switch box 7 and each of the one or more batteries 18 at whatever location is convenient. In the example illustrated in FIG. 1, the batteries 18 are placed toward the bow of the marine vessel 1 and the switch box 7 is located toward the stern near the electric marine drive 3. The batteries 18 are mounted at distance d from the switch box 7, which may be 6 to 7 feet or further. Here, a first battery is closer to the switch box 7 than the second battery. Each of the connection cables 90 may be appropriately sized to enable such connection without excess cable length that takes up space, gets caught or tangled. The connection cable 90 between the switch box 7 and the electric marine drive 3 is also appropriately sized, being shorter since it spans a shorter distance. In other vessels, a different location arrangement of the switch box 7 and/or the batteries 18 may be preferable, such as locating the elements in the middle or towards the sides of the marine vessel, and the system 2 is configured to enable any such arrangement.

The systems 2 illustrated in FIGS. 1-4 include an outboard electric marine drive 3 having an electric motor 4 housed therein, such as housed within the cowling 50 of the outboard electric marine drive 3 or in the torpedo housing 51 or other location near the propeller 10. Although the propulsion systems 2 illustrated in the figures comprise an electric marine drive 3 being an outboard, a person of ordinary skill in the art will understand in view of the present disclosure that embodiments of the electric marine propulsion system 2 may include other types of electric marine drives 3, such as inboard drives or stern drives. The electric motor 4 is operably connected to and configured to rotate the propeller 10. As will be known to the ordinary skilled person in the relevant art, the propeller 10 may include one or more propellers, impellers, or other propulsor devices and the term "propeller" may be used to refer to all such devices. In certain embodiments, the electric motor 4 includes a rotor and a stator in a known configuration. The electric motor 4 may be, for example, a brushless electric motor, such as a brushless DC motor. In other embodiments, the electric motor may be a DC brushed motor, an AC brushless motor, a direct drive, a permanent magnet synchronous motor, an induction motor, or any other device that converts electric power to rotational motion. The motor 4 provides sufficiently high output to propel the marine vessel 1, such as such as up to 250 amps-350 amps at of voltage less than or equal to 60 Vdc.

The electric marine drive 3 is powered by the scalable power storage system 16 that includes one battery 18 or a plurality of batteries 18 connected in parallel. For example, each battery 18 may be a nominal 36 volt or 48 volt battery, or any battery with a maximum operating voltage at or below 60 volts DC. For example, each battery 18 has a maximum operating voltage when fully charged that does not exceed 60 volts, such as 58 volts. The inventors recognized that providing a system configured for operation in the 50 to 60 volt range has advantages of enabling sufficient output, such as powering motors in the 3-5 horsepower range, while also providing a system at voltage levels that are safe and easy for novice users to manage. Each battery 18 is rechargeable, such as by connection to a battery charger 490 when the electric motor 4 is not in use. Various battery devices and systems are known in the relevant art. For example, the power storage system 16 may include one or a plurality of lithium-ion (LI) batteries 18, each LI battery 18 comprised of multiple battery cells. In other embodiments, each battery 18 may be a lead-acid battery, fuel cell, flow battery, ultracapacitor, and/or other devices capable of storing and outputting electric energy.

Referring particularly to FIG. 2, the switch box 7 is configured to accommodate up to four batteries 18*a*-18*d*. Batteries may be connected or disconnected from switch box 7 without interrupting the power connection of the remaining batteries to the electric marine drive 3. This allows a user to add and remove batteries to the system 2 depending on the distance of travel, and to remove low-charge batteries and add fully charged batteries into the system 2 as needed. In FIG. 2, two batteries 18*a* and 18*b* are shown connected, and two batteries 18*c* and 18*d* are not currently connected but are available to be added to power the electric marine drive 3 as needed.

Each battery 18*a*-18*d* is connected to the switch box 7 via a respective connection cable 90*b*. Each connection cable comprises a cable 122*a*-122*b* (only two are shown) having a connector 99, 100 on each end, where one end connects to one battery 18*a*-18*d* and the other end connects to a port on the switch box 7. Each connection cable 90 may comprise identical connectors on each end, or the connectors on either end may be different from one another. In the example shown, the connection cables 90*b* connecting each of the batteries 18*a*-18*d* to the switch box 7 comprise a battery-end connector being an elbow connector 100*a*-100*d* and a switch box-end connector being a straight connector 99*a*-99*b* (only two are shown). The connectors 99, 100 are described in more detail below.

Referring also to FIG. 3, the connection cable 90*d* connecting the electric marine drive 3 to the switch box 7 has elbow connectors 100*y* and 100*z* on each end. In one embodiment, the connectors 100*y* and 100*z* on cable 122*z* are identical, and thus the connection cable 90*d* can be connected in either orientation. The elbow connectors 100*y* and 100*z* may also be identical with elbow connectors 100*a*-100*d*, and likewise the ports on each of the electric marine drive 3 and batteries 18 may be identical. Thus, the drive connection cable 90*d* (and likewise the battery connection cables 90*b* if they also have two identical elbow connectors 100) can also be utilized to connect the electric marine drive 3 directly to the battery 18.

This arrangement is shown in FIG. 4, where the same drive connection cable 90*d* is connected to a battery 18. Specifically, elbow connector 100*y* is moved from the switch box 7 and is connected to the battery 18 instead. This enables a simplified system if only one battery 18 is being used. It also enables easy and direct connection to a battery 18 in a situation where the switch box 7 has a failure.

Each battery 18*a*-18*d* may include an associated battery controller 20*a*-20*d*, which may be a control system comprising multiple controllers that coordinate to control the overall function of the battery 18*a*-*d*. Each battery controller 20*a*-20*d* (e.g., BMS and/or other controllers inside the battery housing) is configured to monitor and/or control the respective battery, including being configured to monitor parameters measured within the battery housing 22*a*-22*d*—such as current, voltage, temperature, pressure, etc.—and determine battery charge level (e.g., battery state of charge and/or battery voltage), battery temperature, battery state of health, etc. The battery controller 20*a*-20*d* may be further configured to determine a power limit for the battery 18*a*-18*d*, which is an amount of power that the battery 18*a*-18*d* can supply without overheating, over-discharging, or otherwise compromising the battery.

The battery controllers 20*a*-20*d* may be configured to communicate those values via a communication link 34 to other control devices in the system 2, including a central controller 12, which in the embodiment shown in FIG. 2 is a propulsion control module (PCM) located in the electric marine drive 3. Other devices, such as steering wheel 36 and throttle lever 38 may also communicate with the central controller 12 via the communication link 34, which may be the same communication means or different. To provide one example, the communication link(s) 34 may be one or more CAN buses, such as operating via a Kingdom Network protocol. As explained in more detail below, the communication link 34 between the batteries 18*a*-18*d* and the electric marine drive 3 runs through the connection cables 90 and the switch box 7.

Each battery controller 20*a*-20*d* may also be configured to control whether the respective battery 18*a*-18*d* is connected to deliver power, and thus is in a power delivery mode, or is inactive and in a disconnected mode in which the battery is disconnected from and not delivering power to the electric marine drive 3. Each battery 18*a*-18*d* includes an internal disconnect switch that internally disconnects the battery cells or other storage elements from the battery output terminals 18+, 18−. Where a battery 18*a*-18*d* is in an inactive state, the respective battery controller 20*a*-20*d* may be configured to communicate a power limit of zero and/or to communicate an error or disconnected status indicating that the battery 18*a*-18*d* is not active or available to provide power.

The electric marine propulsion system 2 is configured to propel the marine vessel 1 in a direction instructed by an operator. In the depicted embodiment, the electric marine drive 3 is an outboard drive steered and controlled by a tiller handle 5, such as one of various tiller arrangements that are well-known in the relevant art. FIG. 2 shows an embodiment including an outboard electric marine drive 3 connected to steering and throttle control devices at the helm, including a steering wheel 36 and a throttle lever 38. Alternatively or additionally, the helm devices may include a joystick, push buttons, a touch screen, or other user input device enabling throttle and/or steering control. Alternatively or additionally, the helm devices may include a computing system and/or a hand-held mobile device, such as a cell phone, communicatively connected to the electric marine drive 3, for example, as part of an onboard management system, such as the VesselView™ and/or VesselView Mobile™ system by Mercury Marine of Fond du Lac, Wisconsin.

A control system of the electric marine propulsion system 2 may include a plurality of control devices configured to cooperate to provide the method of controlling the electric marine propulsion system 2 and the marine batteries 18*a*-*d*, including power mode selection. For example, the control system includes a central controller 12, a plurality of battery controllers 20*a*-20*d*, and one or more motor controllers, trim controllers, steering controllers, etc. communicatively connected, such as by a communication bus. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Each controller may comprise a processor and a storage device, or memory, configured to store software and/or data utilized for controlling and or tracking operation of the electric marine propulsion system 2. The memory may include volatile and/or non-volatile systems and may include removable and/or non-removable media implemented in any method or technology for storage of information. The storage media may include non-transitory and/or transitory storage media, including random access memory, read-only memory, or any other medium which can be used to store information and be accessed by an instruction execution system, for example. An input/output (I/O) system provides communication between the control system and peripheral devices.

FIGS. 5-19 show details of the connection cables 90, including the connectors 100 and cables 122. FIGS. 5-19 also show details of connectors 200, 300 that may serve as the ports on the electric marine drive 3, switch box 7, and batteries 18, and how the connectors 100 can be mated with the connectors 200, 300 to connect the various devices in the electric marine propulsion system 2.

Figure 5:
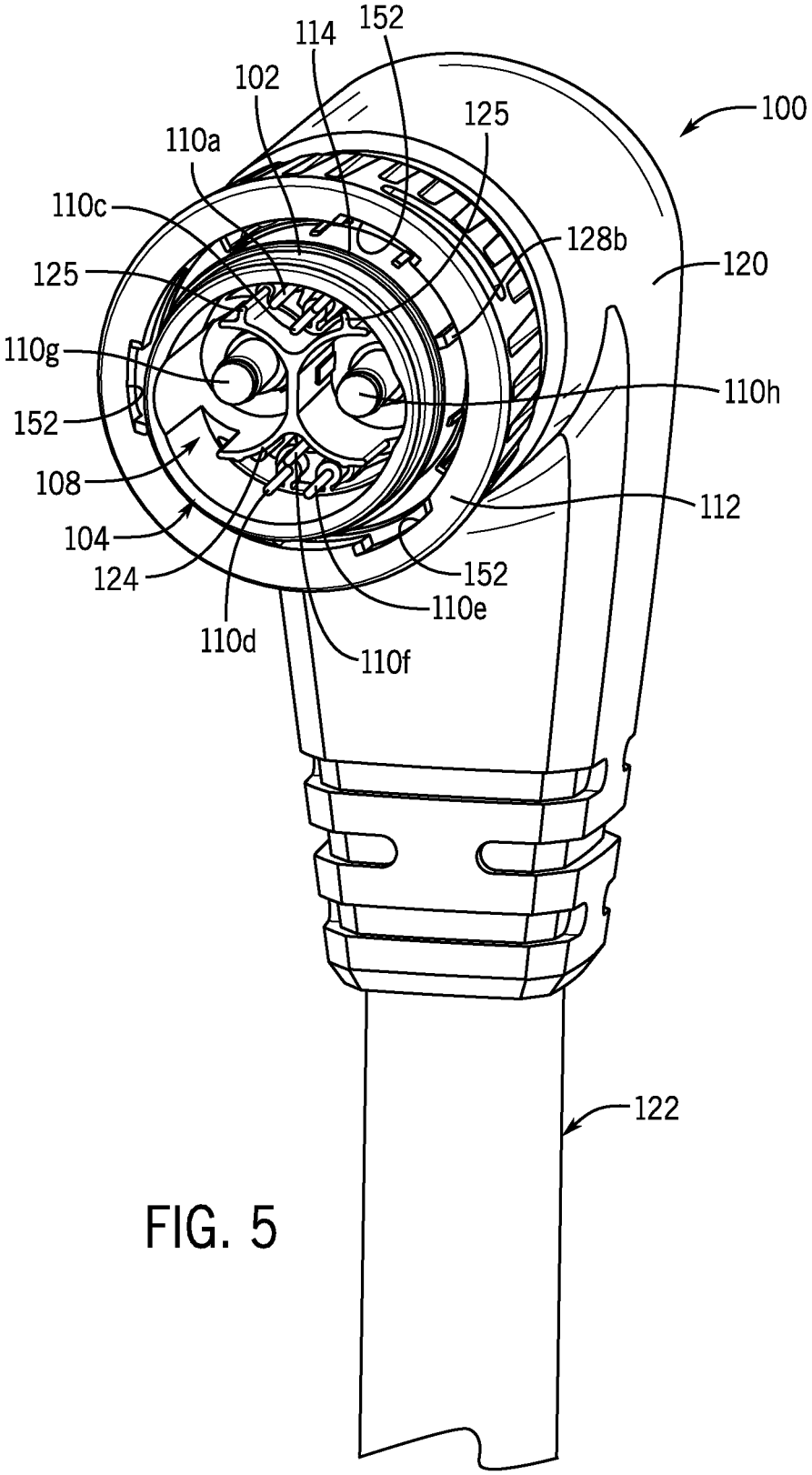
FIG. 5 is a perspective view of a first connector for a marine device of the electric marine propulsion systems of the present disclosure.
Figure 6:
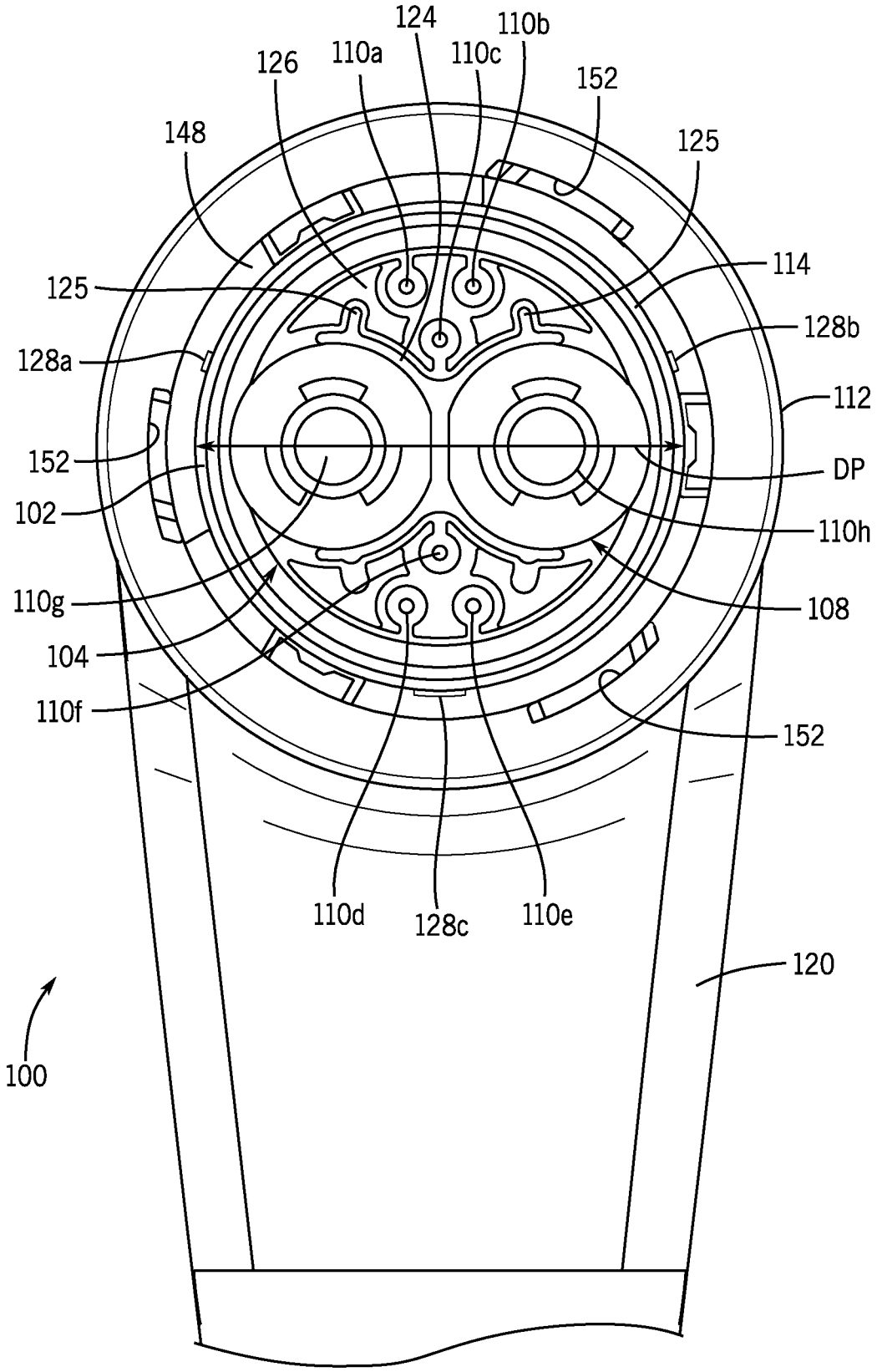
FIG. 6 is a view looking into a housing of the first connector of FIG. 5.
Figure 9:
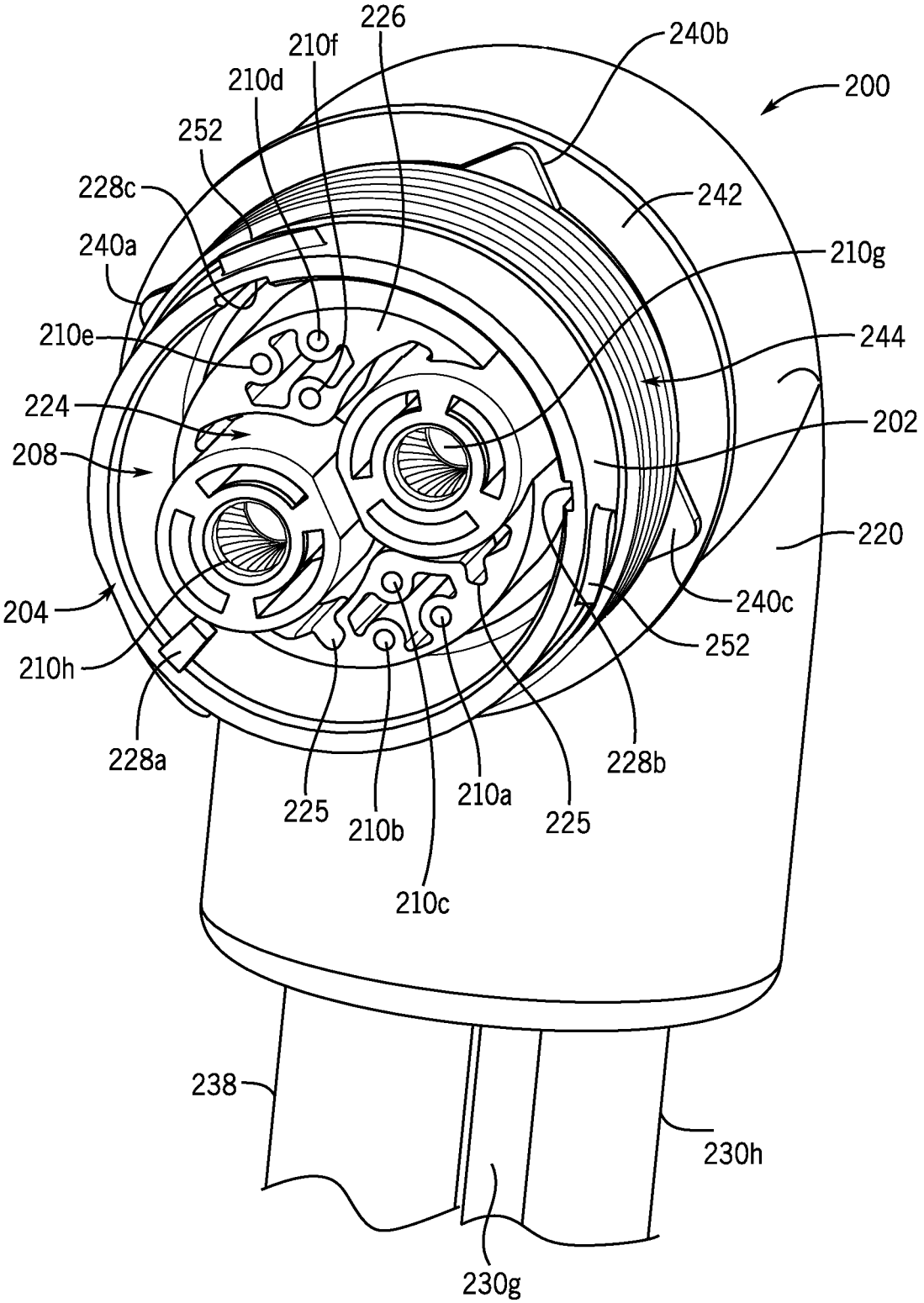
FIG. 9 is a perspective view of a second connector for a marine device of the electric marine propulsion systems of the present disclosure.
Figure 10:
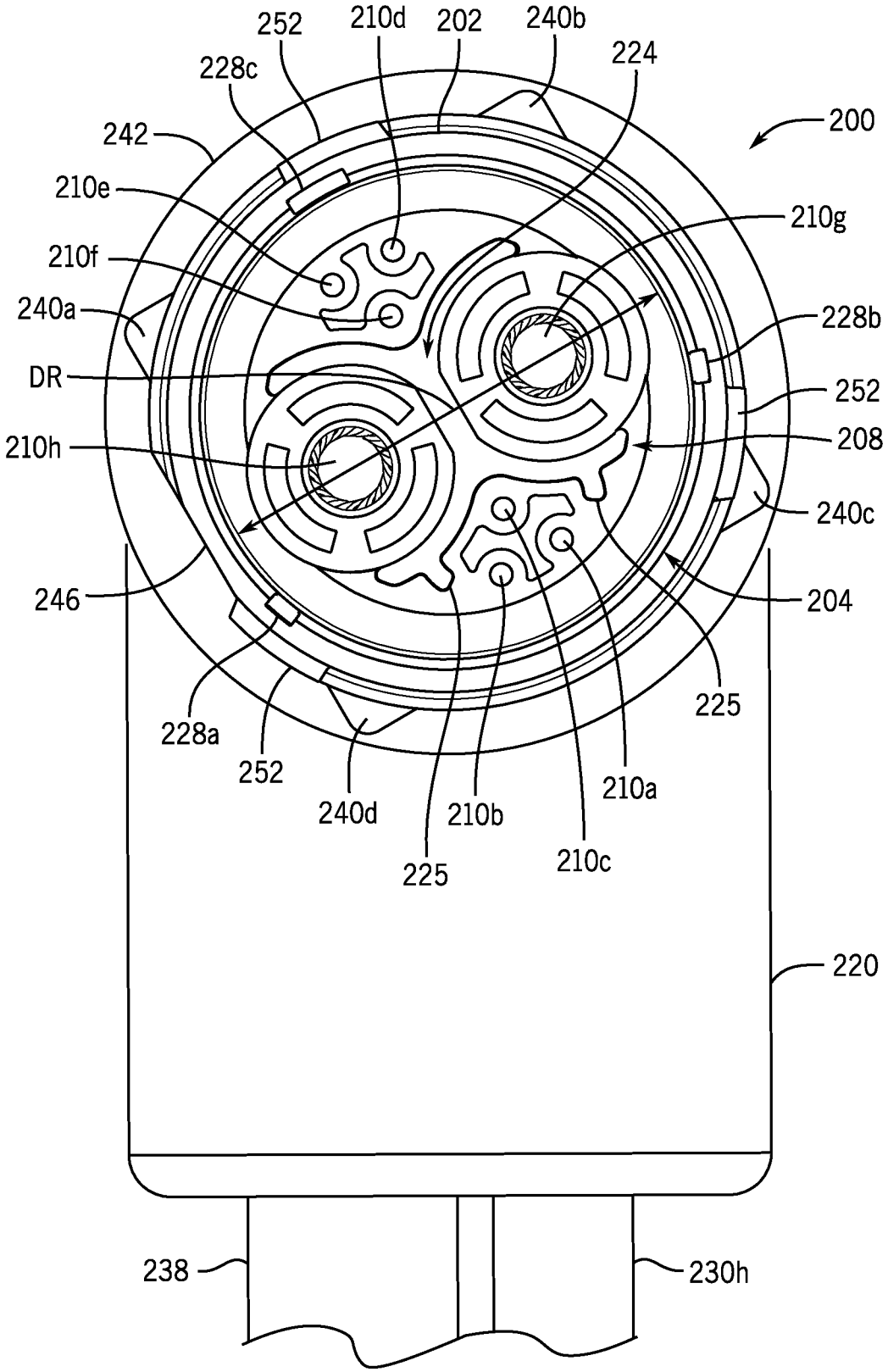
FIG. 10 is a view looking into a housing of the second connector of FIG. 9.
Figure 11:
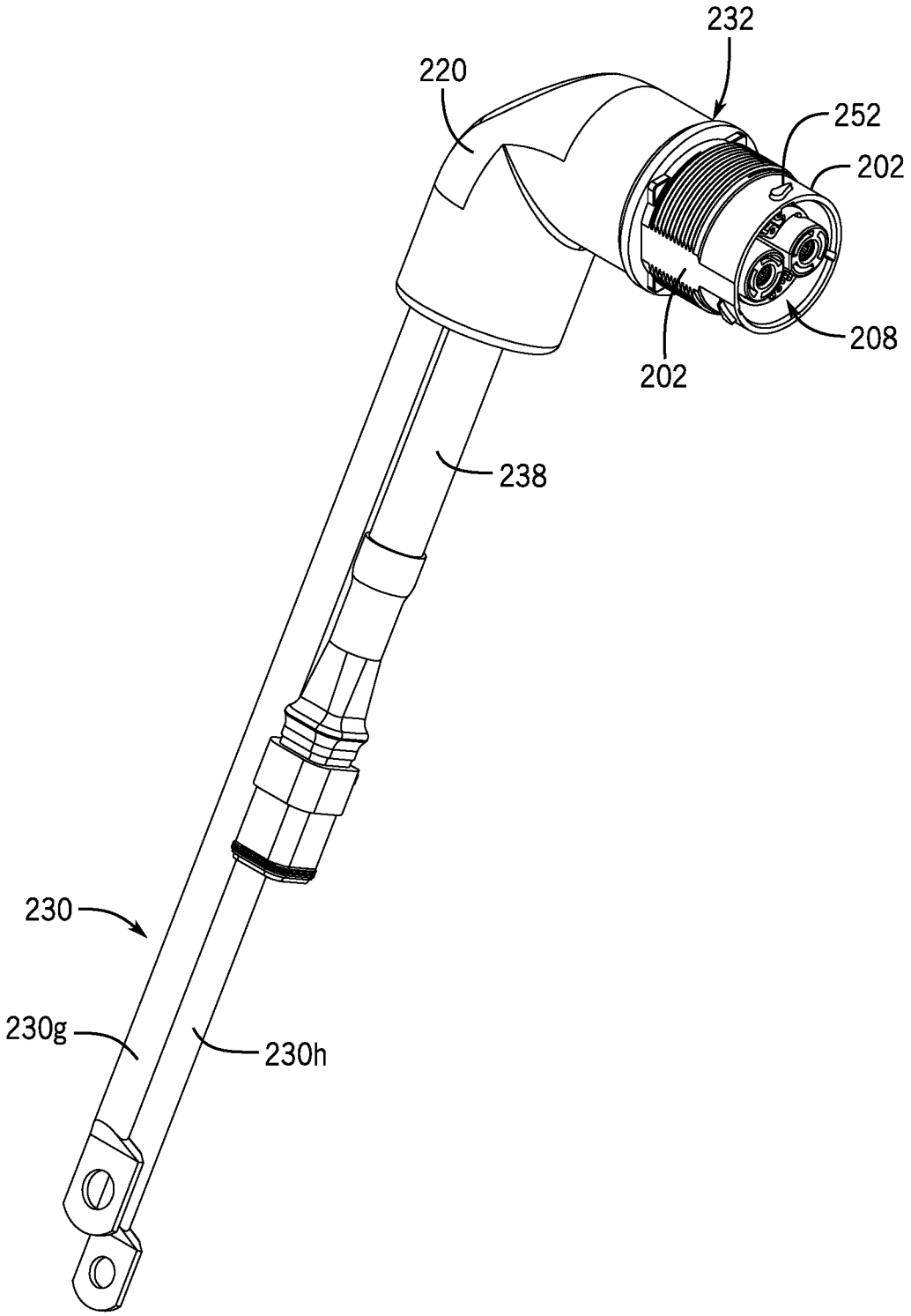
FIG. 11 illustrates the second connector coupled to a cable and wires.
Figure 19:
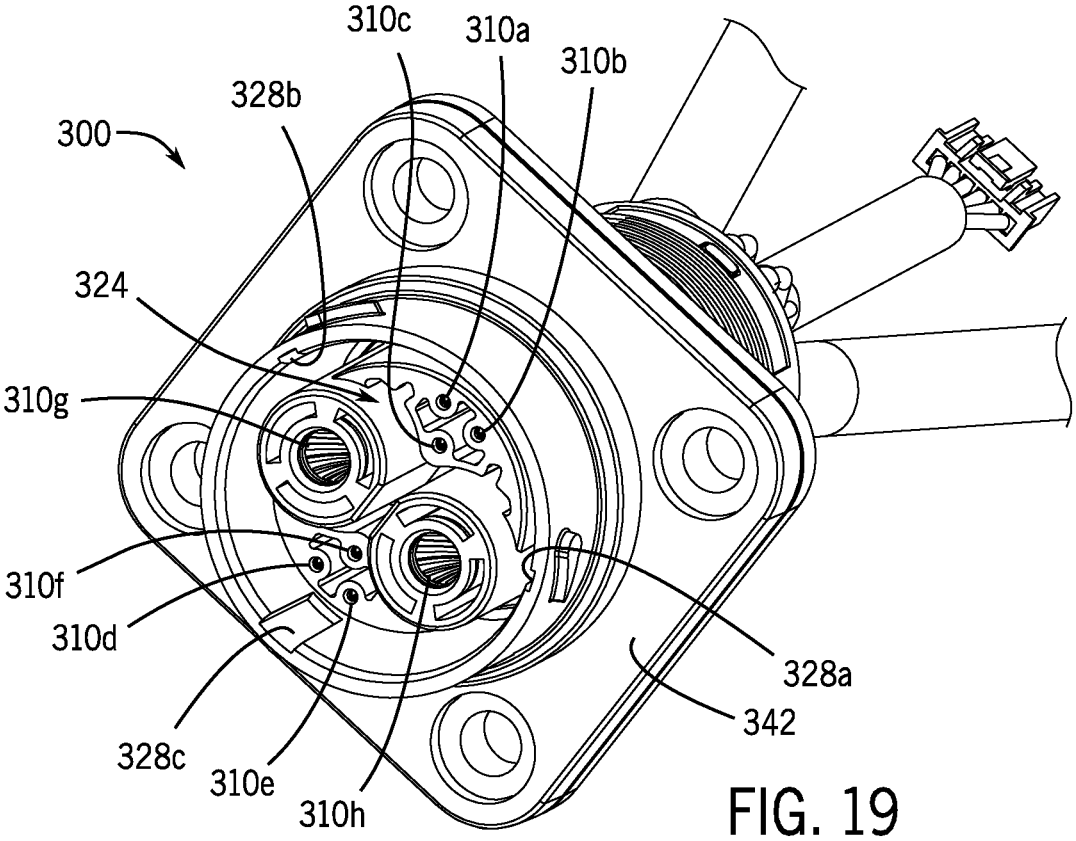
FIG. 19 illustrates a third connector that can be provided on the battery of FIG. 18.

FIG. 5 shows a perspective view of a connector for a marine device, here, the elbow connector 100 provided as part of the connection cables 90 shown in FIGS. 1-4. Thus, the connector 100 of FIG. 5 can be provided on either or both ends of the cables 122 connecting the electric marine drive 3 to the switch box 7 or to the battery 18, or the cables 122 connecting the switch box 7 to the battery 18. As will be described further herein below, the connector 100 is configured to be mated with a connector 200 as shown in FIGS. 9-11 or a connector 300 as shown in FIG. 19. The connector 100 has a barrel-shaped housing 102 having an open first end 104 and an opposite second end 106 (see FIGS. 16 and 17, which show cross sections through the connector 100). FIG. 6 shows a view looking straight into the connector 100 from the first end 104. A plug 108 is provided within the housing 102. The plug 108 comprises a plurality of electrical pins 110*a*-*h* supported within a base surface 126 of the plug 108. A sleeve 112 surrounds the housing 102 and is rotatable with respect to the housing 102 for reasons that will be described herein below. A perimetral seal 114, which may be an elastomeric gasket, is provided about an outer surface of the housing 102. A backshell 120, which will be described further herein below, is provided at the second end 106 of the housing 102 between the housing 102 and a cable 122.

The plurality of electrical pins 110*a*-*h* includes first and second power pins 110*g*, 110*h*. The power pins 110*g*, 110*h* are configured to be electrically connected to the battery 18 to carry electrical power through the cable 122. The power pins 110*g*, 110*h* may have insulators on their distal ends to prevent a user or another device from unintentionally grounding the circuit with a battery 18. The first and second power pins 110*g*, 110*h* are aligned along a diameter DP of the plug 108 and a remainder of the electrical pins 110*a*-*f* in the plurality of electrical pins are symmetrically located on either side of the diameter DP of the plug 108. Specifically, in the present example there are three electrical pins on either side of the diameter DP of the plug 108: electrical pins 110*a*-*c* on a first side of the diameter DP and electrical pins 110*d*-*f* on a second side of the diameter DP. Electrical pin 110*a* is symmetrically located with electrical pin 110*d* with respect to the diameter DP. Electrical pin 110*b* is symmetrically located with electrical pin 110*e* with respect to the diameter DP. Electrical pin 110*c* is symmetrically located with electrical pin 110*f* with respect to the diameter DP. The remainder of the electrical pins 110*a*-*f* may include one or more signal pins, interlock pins, and/or drain pins. The signal pins are configured to be connected to signal wire(s) (e.g., three pins in a CAN bus arrangement CAN high, CAN low, CAN ground) forming part of communication link 34, the interlock pins are configured to be connected to wires forming part of an interlock circuit 500 (see FIGS. 24 and 25 described below), and the drain pin is configured to be connected to a ground wire.

The present inventors placed the power pins 110*g*, 110*h* along the diameter DP of the plug 108 in order to allow the diameter DP of the plug 108 to have as small a dimension as possible. To maximize the space around the power pins 110*g*, 110*h*, the remainder of the electrical pins 110*a-f* may be arranged symmetrically with respect to the diameter DP. Such a placement allows the electrical pins 110*c*, 110*f* to be placed as close to the power pins 110*g*, 110*h* as possible to maintain the plug 108 compact. However, the inventors realized that the symmetry of the electrical pins 110*a-f* about the diameter DP could result in a mating connector 200 (FIG. 9-11) or 300 (FIG. 19) being incorrectly connected to the connector 100. Thus, keys may be provided on the connector 100 to prevent such incorrect connection.

In the depicted examples, an asymmetrical key 124 is provided within the housing 102 and divides the first and second power pins 110*g*, 110*h*. The key 124 has the shape of two "C's" situated back-to-back, each "C" partially surrounding the power pins 110*g*, 110*h*. The key 124 projects from the base surface 126 of the plug 108 toward the first end 104 of the housing. Asymmetry is provided by the inclusion of nubs 125 on the top of each "C," which nubs are not provided on the bottom of each "C." Thus, the key 124 is asymmetrical with respect to the diameter DP of the plug 108. The location, shape, and/or number of nubs 125 could vary from that shown. The key 124 is configured to be received within a corresponding keyway 224 (FIGS. 9, 10) provided in a first portion of the mating connector 200, 300 as will be described herein below. An additional key is provided on the outer surface of the housing 102 of the first connector 100. More specifically, as best shown in FIG. 6, three additional keys 128*a-c* are provided on the outer surface of the housing 102. The keys 128*a* and 128*b* have the same size, but the key 128*c* is wider. In other examples, the keys 128*a-c* all have the same size, or the keys 128*a* and 128*b* are wider than the key 128*c*. The additional key (e.g., keys 128*a-c*) is configured to be received within a corresponding additional keyway (e.g., keyways 228*a-c*, FIGS. 9, 10) formed in a second portion of the mating connector 200, 300.

Figure 7:
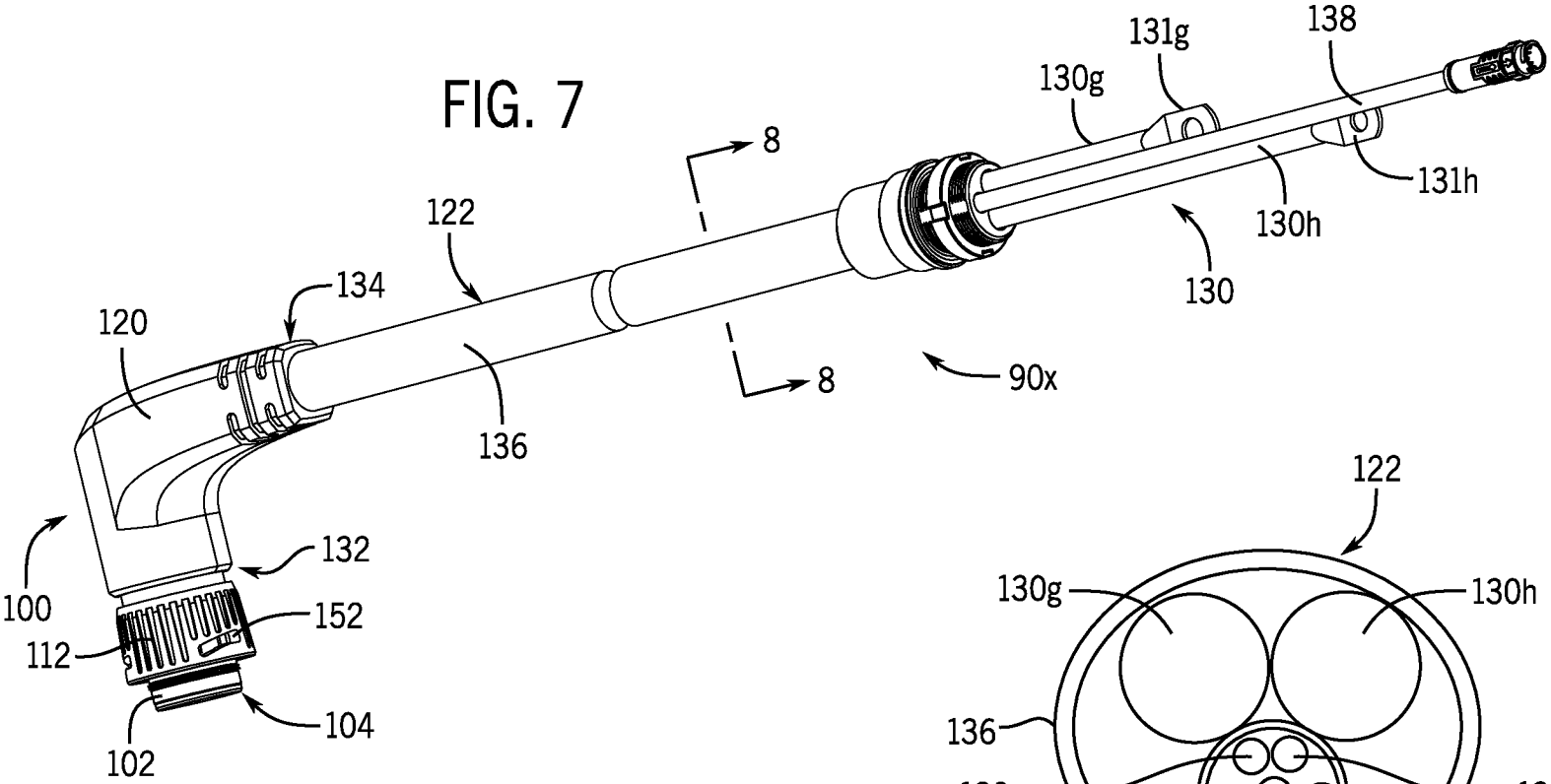
FIG. 7 illustrates the first connector coupled to a cable.
Figure 8:
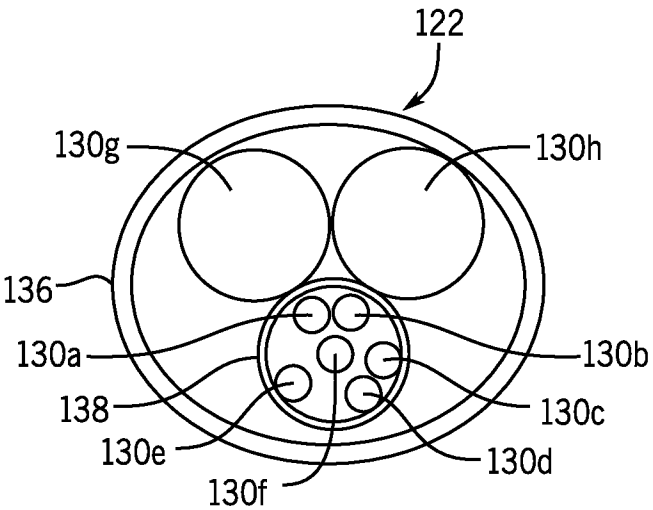
FIG. 8 is a cross section of the cable taken along the line 8-8 in FIG. 7.

Referring now also to FIG. 7, a plurality of wires 130 is respectively connected to the plurality of electrical pins 110*a-h*. The plurality of wires 130 includes at least a first power wire 130*g* and a second power wire 130*h*, connected respectively within the plug 108 to power pins 110*g* and 110*h*. As noted, the power wires 130*g*, 130*h* carry electrical power through the cable 122. The backshell 120 has a first end 132 that interfaces with the second end 106 of the housing 102 and surrounds the plurality of wires 130. A first cable jacket 136 extends from an opposite second end 134 of the backshell 120. The first cable jacket 136 surrounds the plurality of wires 130. A second cable jacket 138 surrounds a subset of the plurality of wires 130, such as the wires that are respectively connected within the plug 108 to the electrical pins 110*a-f*. This subset of pins/wires can be for signal, interlock, and/or drain purposes as noted herein above. The second cable jacket 138 extends through the first cable jacket 136 and shields the signal wires and other wires within the second cable jacket 138 from the power wires 130*g*, 130*h*. A schematic cross-section of the cable 122 is provided in FIG. 8, showing the wires 130*a-f* surrounded by the second cable jacket 138 and showing the second cable jacket 138 and the wires 130*g*, 130*h* surrounded by the first cable jacket 136.

FIG. 9 shows a perspective view of another connector 200 for a marine device, such as for the electric marine drive 3 shown in FIGS. 1-4. In one example, the connector 200 forms the port provided on the electric marine drive 3 to which the elbow connector 100 can be mated. The connector 200 includes a housing 202 configured to pass through an aperture in the outer cowling 50 of the electric marine drive 3, as will be described further herein below. The housing 202 has an open first end 204 and an opposite second end 206 (see FIGS. 16 and 17, which show cross sections through the connector 200). FIG. 10 shows a view looking straight into the connector 200 from the first end 204. A receptacle 208 is located within the housing 202. The receptacle 208 comprises a plurality of electrical sockets 210*a-h* formed in an end surface 226 of the receptacle 208. A plurality of wires, including wires 230*g*, 230*h*, is respectively connected to the plurality of electrical sockets (e.g., wire 230*g* is connected to electrical socket 210*g* and wire 230*h* is connected to electrical socket 210*h*). A backshell 220 interfaces with the second end 206 of the housing 202 and surrounds the plurality of wires 230*g*, 230*h* and a cable jacket 238, which in turn surrounds additional wires, as will be described further herein below.

In the present example, the plurality of electrical sockets 210*a-h* includes first and second power sockets 210*g*, 210*h*. As noted, the power sockets 210*g*, 210*h* are configured to be connected to power wires 230*g*, 230*h*, which are configured to conduct electrical power when a battery 18 is electrically connected to the connector 200 as shown in FIGS. 1-4. The power wires 230*g*, 230*h* are configured to be connected to the electric motor 4 to provide power thereto. The receptacle 208 is generally cylindrical and the first and second power sockets 210*g*, 210*h* are aligned along a diameter DR of the receptacle 208. A remainder of the electrical sockets 210*a-f* in the plurality of electrical sockets are symmetrically located on either side of the diameter DR of the receptacle 208. Specifically, in the present example there are three electrical sockets on either side of the diameter DR of the receptacle 208: electrical sockets 210*a-c* on a first side of the diameter DR and electrical sockets 210*d-f* on a second side of the diameter DR. Electrical socket 210*a* is symmetrically located with electrical socket 210*d* with respect to the diameter DR. Electrical socket 210*b* is symmetrically located with electrical socket 210*e* with respect to the diameter DR. Electrical socket 210*c* is symmetrically located with electrical socket 210*f* with respect to the diameter DR. The remainder of the electrical sockets 210*a-f* may include one or more signal sockets, interlock sockets, and/or drain sockets, which are configured to be connected to signal wires, interlock wires, and/or drain wires, respectively.

The present inventors placed the power sockets 210*g*, 210*h* along the diameter DR of the receptacle 208 in order to allow the diameter DR of the receptacle 208 to have as small a dimension as possible. In order to fill the space around the power sockets 210*g*, 210*h*, the present inventors then placed the remainder of the electrical sockets 210*a-f* symmetrically with respect to the diameter DR. Such a placement allows the electrical sockets 210*c*, 210*f* to be placed as close to the power sockets 210*g*, 210*h* as possible to maintain the receptacle 208 compact. However, the present inventors then realized that the symmetry of the electrical sockets 210*a-f* about the diameter DR could result in a mating connector 100 (FIGS. 5-7) being incorrectly connected to the connector 200. Thus, the present inventors provided keyways on the connector 200 to prevent such incorrect connection.

Specifically, the connector 200 comprises an asymmetrical keyway 224 provided in the receptacle 208 and dividing the first and second power sockets 210*g*, 210*h*. The keyway 224 is recessed from the end surface 226 of the receptacle 208 and has the shape of two "C's" situated back-to-back, each "C" partially surrounding a respective power socket 210*g* or 210*h*. Asymmetry is provided by the inclusion of recesses 225 on the bottom of each "C," which recesses are not provided on the top of each "C." Thus, the keyway 224 is asymmetrical with respect to the diameter DR of the receptacle 208. The location, shape, and/or number of recesses 225 could vary from that shown, but should match the location, shape, and/or number of nubs in the plug 108. The keyway 224 is configured to receive the corresponding key 124 provided on a portion of the mating connector 100 (FIGS. 5-6). An additional keyway is formed in an inner surface of the housing 202. More specifically, three additional keyways 228*a-c* are provided in the inner surface of the housing 202. Keyways 228*a*, 228*b* are narrower than keyway 228*c*, but in other examples, all keyways 228*a-c* could have the same width, or keyway 228*c* could be narrower than keyways 228*a* and 228*b*. The additional keyway (e.g., keyways 228*a-c*) is configured to receive the corresponding additional key (e.g., keys 128*a-c*) provided on a portion of the mating connector 100.

Referring now also to FIG. 11, as noted hereinabove, a plurality of wires 230 is respectively connected to the plurality of electrical sockets 210*a-h* in the receptacle 208. The plurality of wires 230 includes at least a first power wire 230*g* and a second power wire 230*h*, connected respectively within the receptacle 208 to power sockets 210*g* and 210*h*. These power wires 230*g*, 230*h* are configured to carry electrical power when a battery 18 is connected to the receptacle 208 via the plug 108 of a given connection cable 90. The backshell 220 has a first end 232 that interfaces with the second end 206 of the housing 202 (see also FIGS. 16 and 17) and surrounds the plurality of wires 230. A subset of the plurality of wires 230 is provided within a separate cable jacket 238. The subset of wires in the cable jacket 238 may include the signal, interlock, and drain wires, which may have the same purposes as the signal, interlocks and drain wires described hereinabove with respect to the first connector 100.

Referring back to FIGS. 9 and 10, the housing 202 comprises a geometrical feature extending outwardly from an outer surface of the housing 202. Specifically, the housing 202 comprises four geometrical features 240*a-d*, each in the form of a triangle. The geometric features 240*a-d* are raised with respect to a flange 242 that surrounds the housing 202 at the second end 206 of the housing 202. The geometric features 240*a-d* are equally spaced and together form four points of a square centered on the housing 202. However, the geometric features could instead form three points of a triangle or could be unequally spaced.

Figure 12:
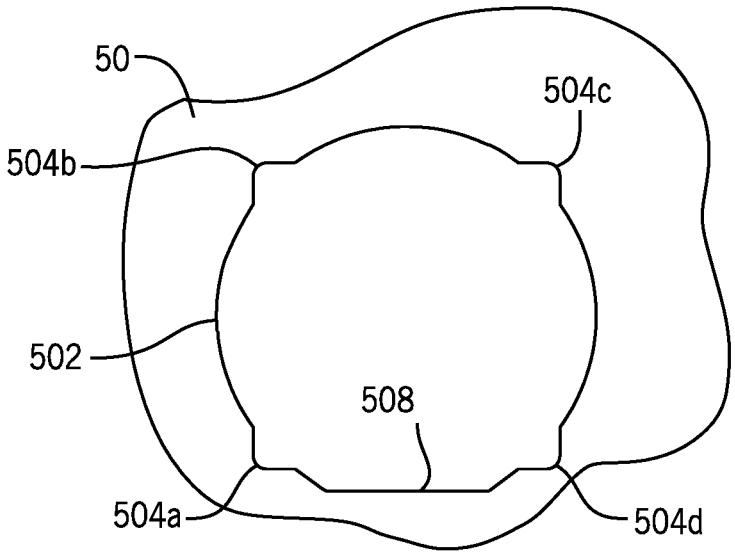
FIG. 12 shows an aperture that may be provided in a cowling of an electric marine drive to install the second connector of FIGS. 9-11 therein.
Figure 13:
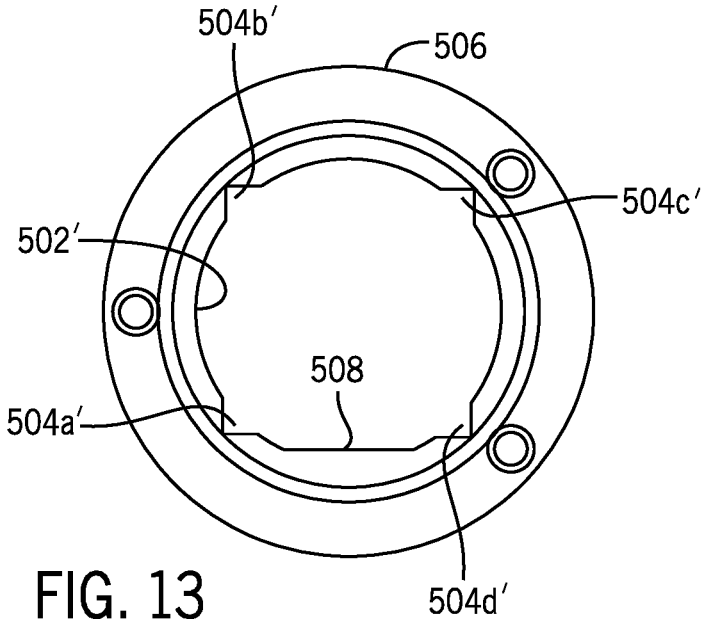
FIG. 13 shows an adapter that may be used to provide the aperture in the cowling of the electric marine drive.
Figure 14:
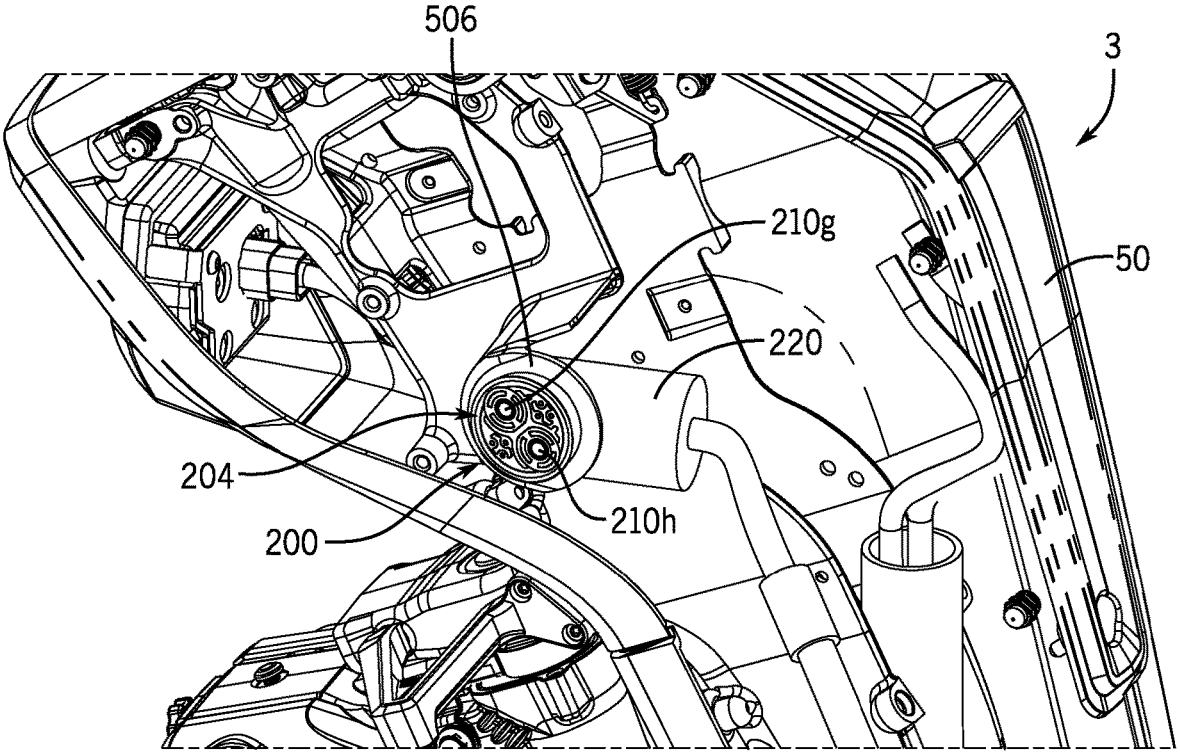
FIG. 14 shows a portion of an electric marine drive with the second connector of FIGS. 9-11 installed therein.

Referring to FIGS. 12-14, as noted hereinabove, the housing 202 of the connector 200 is configured to pass through an aperture 502 in an outer cowling 50 of the electric marine drive 3. The geometrical feature on the housing 202 of the second connector 200 is configured to be received in a corresponding geometrical feature in the aperture 502 in the outer cowling 50 in a manner that prevents rotation of the housing 202 with respect to the aperture 502 and thus the cowling 50. Specifically, the geometrical features 240*a-d* on the housing 202 are configured to be received in corresponding geometrical features 504*a-d* in the aperture 502 in the outer cowling 50 in a manner that prevents rotation of the housing 202 with respect to the aperture 502. The geometrical features 504*a-d* are also in the shape of triangles spaced equally apart and forming the corners of a square centered on what is otherwise a generally circular aperture 502 having a diameter slightly larger than the diameter of the housing 202. The geometrical features 504*a-d* can be made directly in the cowling 50 as shown in FIG. 12 or can be made in an adapter 506 as shown in FIG. 13. If the adapter 506 is used, the geometrical features 504*a*'-d' are preformed in the adapter 506, the cowling 50 is cut or formed to the outside shape of the adapter 506 (here, a circle), and the adapter 506 is inserted in the appropriately sized space in the cowling 50. Using an adapter may 506 make manufacturing of the cowling 50 easier and/or may allow for more precise forming of the aperture 502' and geometrical features 504*a*'-d'.

FIG. 14 shows a portion of the electric marine drive 3 with the cowling 50 on the near side of the electric marine drive 3 removed so that the location of the adapter 506 and connector 200 situated therein can be seen. With the connector 200 placed inside the cowling 50 and the first end 204 of the housing 202 facing outwardly, the geometrical features 240*a-d* and 504*a-d* or 504*a*'-d' are respectively aligned and the housing 202 of the connector 200 is pushed through the aperture 502 or 502' from the inside of the cowling 50. The connector 200 is configured to be installed through the aperture 502 or 502' in the outer cowling 50 such that the backshell 220 and a portion of the housing 202 are located internally of the outer cowling 50 and a remainder of the housing 202 (e.g., at least the first end 204 thereof) is located externally of the outer cowling 50. The flange 242 on the connector 200 sits just internally of the cowling 50, while the geometric features 240*a-d* sit directly within the corresponding geometric features 504*a-d* or 504*a*'-d' of the aperture 502 or 502'. A washer and nut may be placed over the first end 204 of the housing 202 and the nut tightened via the threads 244 (FIG. 9) on the outer surface of the housing 202 until the washer contacts the cowling 50 or the adapter 506. The adapter 506 is then held in place between the washer and nut on the outside of the cowling 50 and the flange 242 of the housing 202 on the inside of the cowling 50. The situating of the geometric features 240*a-d* within geometrical features 504*a-d* or 504*a*'-d' ensures that the connector 200 will not rotate with respect to the cowling 50 when external forces (such as connection/disconnection of the connector 100 or jiggling of the cable 122 during use) tend to place a torque on the connector 200. Such an anti-rotation feature provided by geometric features 240*a-d* within geometrical features 504*a-d* or 504*a*'-d' goes beyond that already provided by the D-flat 246 on the housing 202 (FIG. 10) and the corresponding D-flat 508 or 508' in the aperture 502 (FIGS. 12 and 13), which latter feature the present inventors determined is not enough to secure the connector 200 from rotating due to the location of the connector 200 as being nearly flush with the outer cowling 50.

Figure 15:
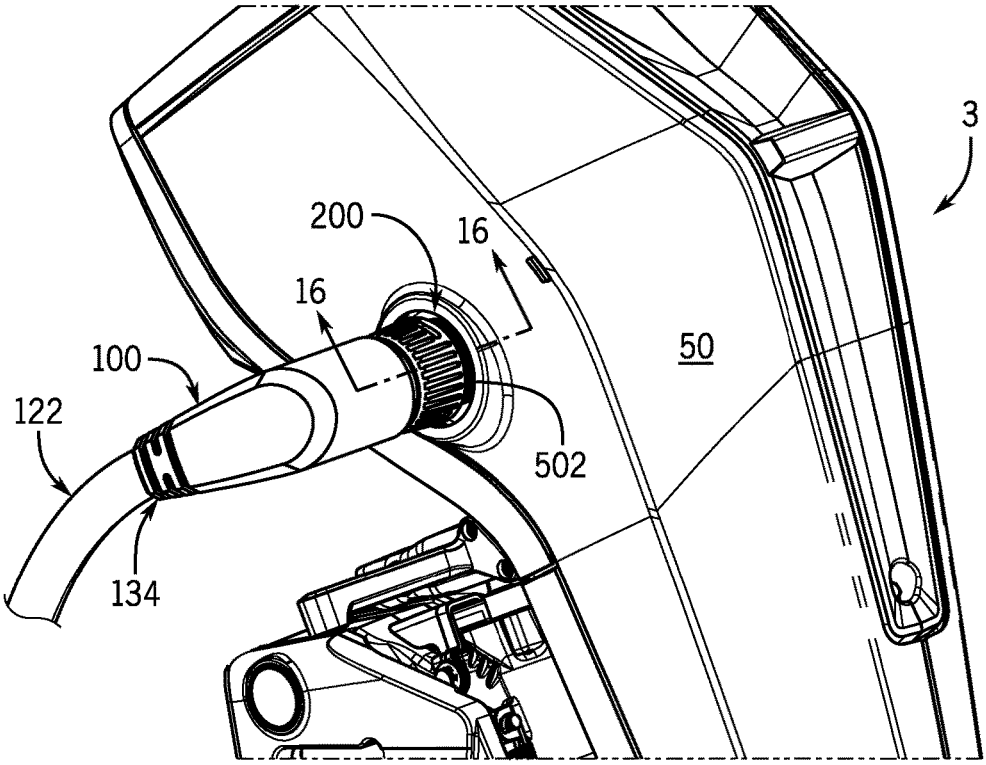
FIG. 15 shows a portion of the electric marine drive of FIG. 14 with the first connector of FIGS. 5-7 mated with the second connector of FIGS. 9-11.

As shown in FIG. 14, the electric marine drive 3 is more or less in a vertically upright position. In other words, its steering shaft is more or less perpendicular with respect to the surface of the water in which the electric marine drive 3 is operating. This may be the case when, for example, the electric marine drive 3 is in a neutral trim position, not trimmed in or trimmed out. The connector 200 is configured to be installed in the electric marine drive 3 such that the first and second power sockets 210*g*, 210*h* are not vertically aligned with one another when the electric marine drive 3 is in the upright position. This clocking correlates to an intuitive and ergonomic connection of the connector 100 of FIGS. 5-7 with the connector 200 of FIGS. 9-11, as shown in FIG. 15. Specifically, the connector 100 is configured to connect with the connector 200 in a manner such that the second end 134 of the backshell 120 is located forwardly (with respect to the marine vessel) of the housing 102 where connection is made to the electric marine drive 3. Such an orientation of the elbow-shaped connector 100 makes it easy for a user to grip the connector 100 with their right hand to connect/disconnect the connector 100 to/from the connector 200 while on the marine vessel. In terms of human-machine interaction, it would be counterintuitive for a user to flip the connector 100 in an opposite direction in which the backshell 120 cannot be used as a "handle" of sorts to hold the connector 100. This intuitive "handle" feature of the elbow connector 100 thus also prevents attempts to incorrectly mate the connectors 100, 200.

FIGS. 14 and 15 also show how the connector 200 is used to create a power/signal port on the cowling 50 of the electric marine drive 3 that is aesthetically pleasing and prevents water ingress. The port sheds water due to its vertical orientation and does not hang off of the electric marine drive 3 as do current pigtail-style assemblies. This makes it easier for a user to remove the electric marine drive 3 from the marine vessel and transport and/or store it elsewhere, as the user does not need to worry about electronic equipment hanging off of or out of the cowling 50 being damaged. The port on the electric marine drive 3 can be provided with a waterproof cap that mates to the connector 200 and/or with a hatch-type door on the cowling 50.

Figure 16:
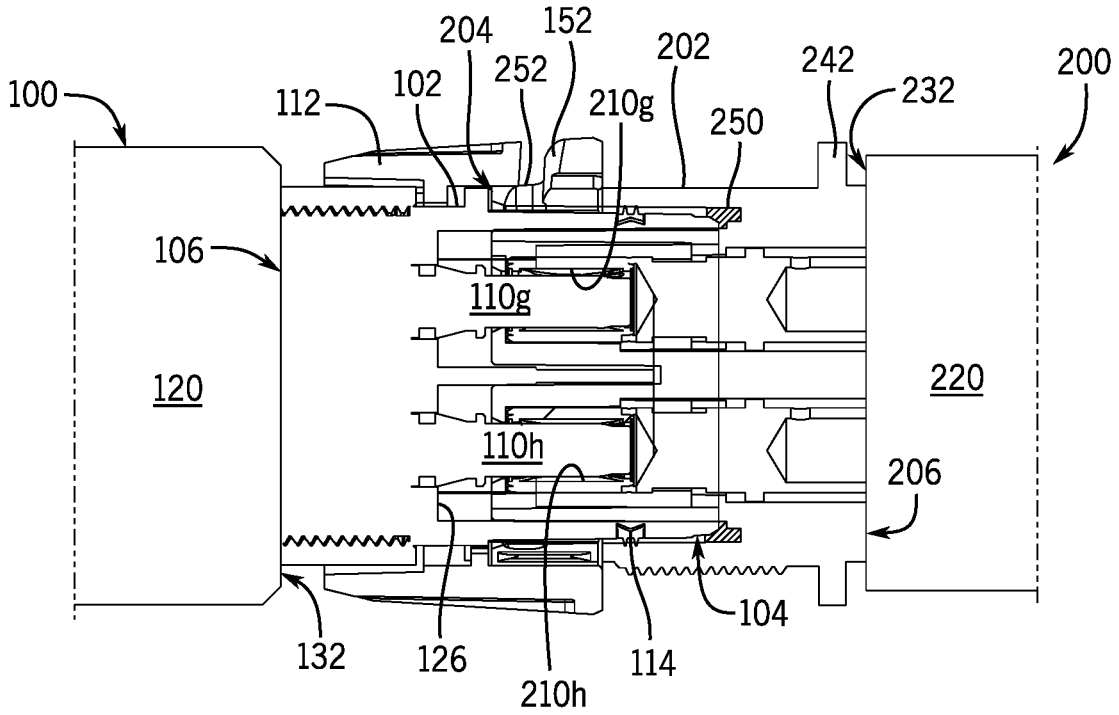
FIG. 16 is a cross section of the mated first and second connectors taken along the line 16-16 in FIG. 15.
Figure 17:
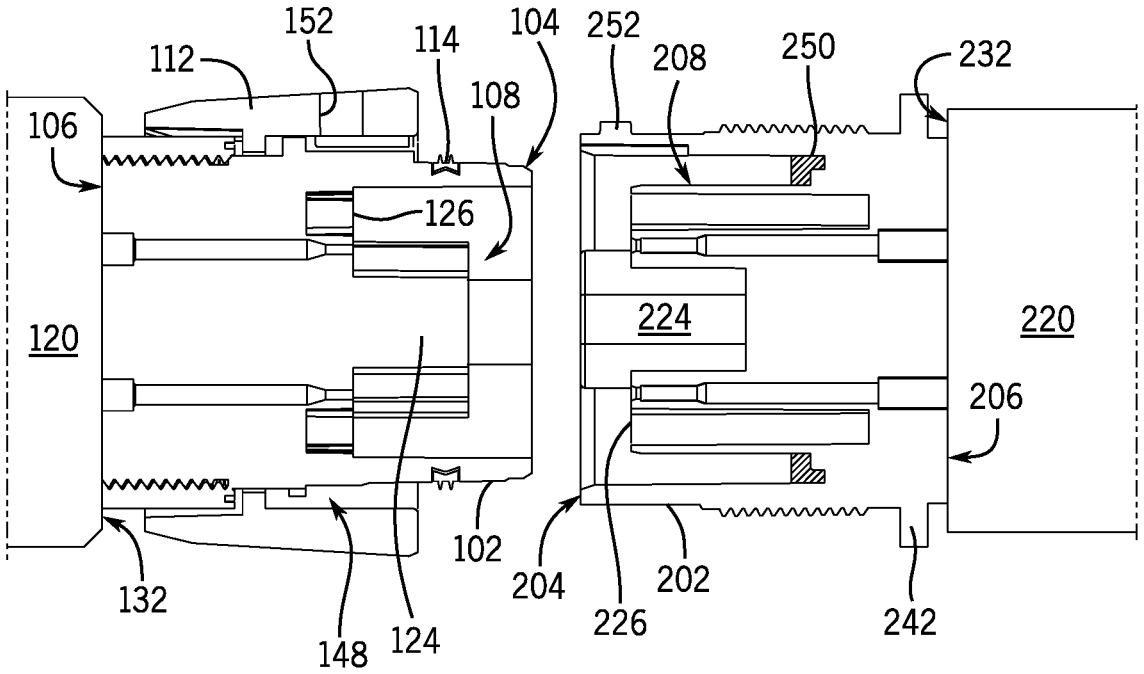
FIG. 17 is a cross section of the first and second connectors taken perpendicular to the cross section of FIG. 16, with the first and second connectors not being mated together.

As shown in FIGS. 16 and 17, according to the present disclosure, the housing 102 of the connector 100 is configured to receive a first portion (here, the receptacle 208) of the mating connector 200 via the first end 104 of the housing 102. An annular gap 148 (see also FIG. 6) between the outer surface of the housing 102 and the sleeve 112 is configured to receive a second portion (here, a distal portion of the housing 202) of the mating connector 200, and the perimetral seal 114 is configured to contact the second portion (i.e., the annular inside surface of the housing 202) of the mating connector 200. Simultaneously, the housing 202 of the connector 200 is configured to receive a portion (here, the distal portion of the housing 102) of the mating connector 100 via the first end 204 of the housing 202. Once the two connectors 100, 200 have been mated, the sleeve 112 can be twisted about the housings 102 and 202 such that keys 252 on the outer surface of the housing 202 ride within slots 152 in the sleeve 112 to lock the connectors 100, 200 together against accidental disconnection.

Note that the power pins 110*g*, 100*h* are longer than the electrical pins 110*a-f* (see FIGS. 5-6) and therefore the power pins 110*g*, 100*h* mate with the power sockets 210*g*, 210*h* (see FIG. 16) before the electrical pins 110*a-f* mate with the electrical sockets 210*a-f*. The connectors are thus designed such that the power pins 100*g*, 100*h* can carry 100% rated current from the battery 18 to the electric motor 4 after the signal pins (which are a subset of the pins 100*a-e*) mate with their respective sockets provided that the interlock circuit 500 is completed, as described in more detail below.

Thus, the present disclosure is of a pair of connectors 100, 200 for marine devices, the pair of connectors 100, 200 comprising a first connector 100 and a second connector 200. The first connector 100 comprises a first housing 102 having an open first end 104 and an opposite second end 106. A plug 108 is provided within the first housing 102, the plug 108 comprising a plurality of electrical pins 110*a-h*. First and second electrical pins 110*g*, 110*h* of the plurality of electrical pins are aligned along a diameter DP of the plug 108 and a remainder of the electrical pins 110*a-f* in the plurality of electrical pins are symmetrically located on either side of the diameter DP of the plug. The first connector 100 also comprises a sleeve 112 surrounding the first housing 102 and an asymmetrical key 124 provided within the first housing 102 and dividing the first and second electrical pins 110*g*, 110*h*. The second connector 200 comprises a second housing 202 having an open first end 204 and an opposite second end 206. A receptacle 208 is located within the second housing 202, the receptacle 208 comprising a plurality of electrical sockets 210*a-h*. First and second electrical sockets 210*g*, 210*h* of the plurality of electrical sockets are aligned along a diameter DR of the receptacle 208 and a remainder of the electrical sockets 210*a-f* in the plurality of electrical sockets are symmetrically located on either side of the diameter DR of the receptacle 208. The second connector 200 also comprises an asymmetrical keyway 224 provided in the receptacle 208 and dividing the first and second electrical sockets 210*g*, 210*h*.

The first housing 102 of the first connector 100 is configured to receive the receptacle 208 of the second connector 200 via the first end 104 of the first housing 102. A gap 148 between an outer surface of the first housing 102 and the sleeve 112 is configured to receive the second housing 202 of the second connector 200. Further, the keyway 224 of the second connector 200 is configured to receive the key 124 of the first connector 100. An additional key 128*a-c* is provided on the outer surface of the first housing 102 and an additional keyway 228*a-c* is formed in an inner surface of the second housing 202. The additional keyway 228*a-c* is configured to receive the additional key 128*a-c*. The keys and keyways prevent incorrect connection of the connectors 100, 200 as the connectors 100, 200 are physically incapable of mating unless all keys are aligned with all corresponding keyways.

The second connector 200 further comprises a plurality of wires 230 respectively connected to the plurality of electrical sockets 210*a-h* and a backshell 220 interfacing with the second end 206 of the second housing 202 and surrounding the plurality of wires 230. The second connector 200 is configured to be installed through an aperture 502 in an outer cowling 50 of an electric marine drive 3 such that the backshell 220 and a portion of the second housing 202 are located internally of the outer cowling 50 and a remainder of the second housing 202 is located externally of the outer cowling 50. The second connector 200 is configured to be installed in the electric marine drive 3 such that the first and second electrical sockets 210*g*, 210*h* are not vertically aligned with one another when the electric marine drive 3 is in an upright position. The second housing 202 comprises a geometrical feature 240*a-d* extending outwardly from an outer surface of the second housing 202. The geometrical feature 240*a-d* on the second housing 202 is configured to be received in a corresponding geometrical feature 504*a-d* or 504*a*'-d' in the aperture 502 or 502' in the outer cowling 50 in a manner that prevents rotation of the second housing 202 with respect to the aperture 502 or 502'.

A plurality of wires 130 is respectively connected to the plurality of electrical pins 110*a-h* of the first connector 100. A backshell 120 has a first end 132 interfacing with the second end 106 of the first housing 102 and surrounds the plurality of wires 130. A first cable jacket 136 extends from an opposite second end 134 of the backshell 120. The first cable jacket 136 surrounds the plurality of wires 130. A second cable jacket 138 surrounds a subset 130*a-f* of the plurality of wires. The second cable jacket 138 extends through the first cable jacket 136 to shield the wires in the second cable jacket 138 from those outside the second cable jacket 138.

FIGS. 16 and 17 also show a first perimetral seal 250 located within the second housing 202 around an outer surface of the receptacle 208. The first perimetral seal 250 is configured to abut the first end 104 of the first housing 102 when the connectors 100, 200 are mated. A second perimetral seal 114 is provided about an outer surface of the first housing 102. The second perimetral seal 114 is configured to contact an inner surface of the second housing 202 when the connectors 100, 200 are mated. The second perimetral seal 114 is located between the first and second ends 104, 106 of the first housing 102. While the first perimetral seal 250 can provide a watertight seal when the connectors 100, 200 are mated perfectly and one is not tilted with respect to the other, the second perimetral seal 114 is able to provide a watertight seal even when the first connector 100 is tilted with respect to the second connector 200.

Figure 18:
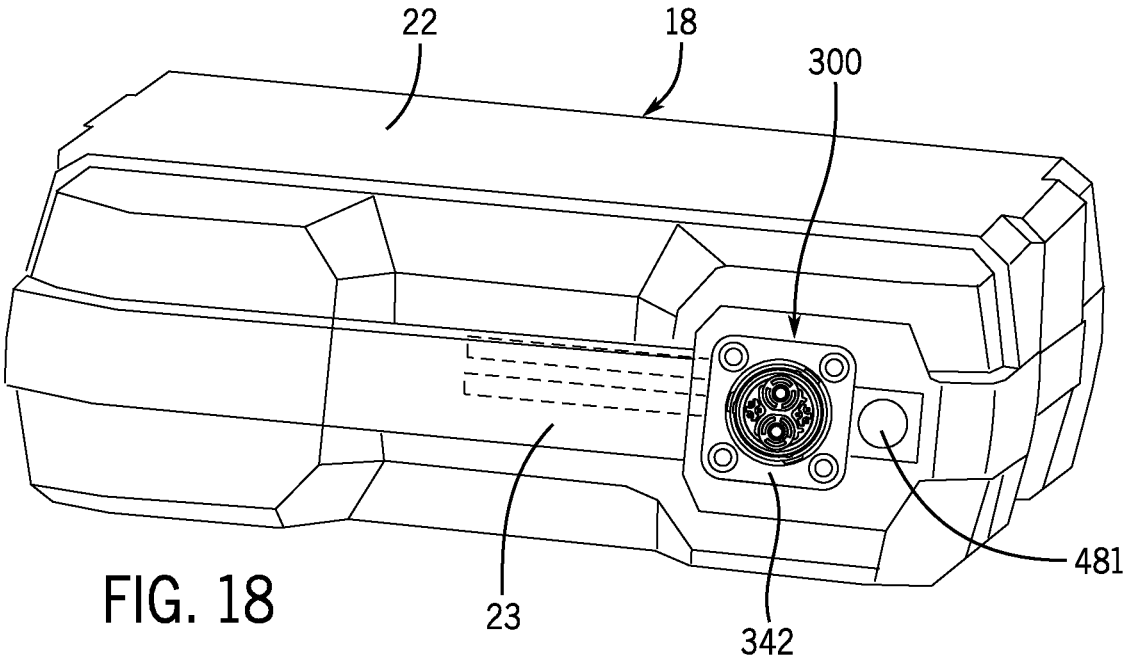
FIG. 18 illustrates a battery according to the present disclosure.

FIG. 18 shows a battery 18 according to the present disclosure, on which a battery port is provided as noted hereinabove with respect to FIGS. 1-4. The battery port is itself a connector 300 very similar to the connector 200 provided on the electric marine drive 3. The connector 300 has a flange 342 providing for connection to the battery housing 22. Other than the shape of this flange 342, the lack of a D-flat 246, threads 244, or geometrical features 240*a-d* on the connector 300 (all of which may be particular to a connector 200 to be installed on the cowling 50), the remainder of the connector 300 is identical to the connector 200. Parts of the connector 300 that are labeled with a "3" in the hundreds place correspond to the same parts labeled with a "2" in the hundreds place and the same two numerals in the tens and ones places. Therefore, each of the parts of the connector 300 will not be described further herein. The connector 100 can be mated to the connector 300 in the same way as described with respect to FIGS. 16 and 17 regarding mating of the connectors 100 and 200. Thus, the same connector 100 can be used to mate to the connector 300.

Referring now to all the figures, one of ordinary skill in the relevant art would understand that various configurations of connectors 100, 200, 300 and cables could be provided for any given connection cable 90 in the electric marine propulsion system 2. For instance, the connection cable 90*d* of FIG. 2 has an elbow connector 100*y*, 100*z* on either end, each connector 100*y*, 100*z* being the same as the connector 100 described with respect to FIGS. 5-7. In other examples, it may be beneficial to use a connector cable 90*x* like that shown in FIG. 7, with ring terminals 131*g*, 131*h* on the ends of the power wires 130*g*, 130*h* for connection to the switch box 7 or to the battery 18. In still other examples, straight connectors can be used on one or both ends of a connection cable 90, such as the straight connectors 99*a*, 99*b* shown on the switch box 7 in FIG. 2. These straight connectors would have the same connective configuration (i.e., plug 108) as those of the elbow connector 100 described with respect to FIGS. 5-7, but a different backshell shape to allow for connection of multiple connectors 99 immediately adjacent one another on the switch box 7. Thus, each of the ports on the electric marine drive 3, the switch box 7, and the batteries 18 may have the female configuration of the receptacle 208 described with respect to FIGS. 9-11, while each of the elbow and straight connectors on the ends of connection cables 90 may have the male configuration of the plug 108 described with respect to FIGS. 5-7. It is contemplated that any given connection cable 90 can have one of the following configurations: elbow connectors on both ends; elbow connector on one end and straight connector on the other end; straight connectors on both ends; elbow connector on one end and ring terminals on the other end; straight connector on one end and ring terminals on the other end. In the case where ring terminals are provided on a connection cable 90, the marine device to which the ring terminals are to be connected includes screws for connection of the ring terminal to the device's circuit. A receptacle for the separate signal cable is then also provided.

Figure 20:
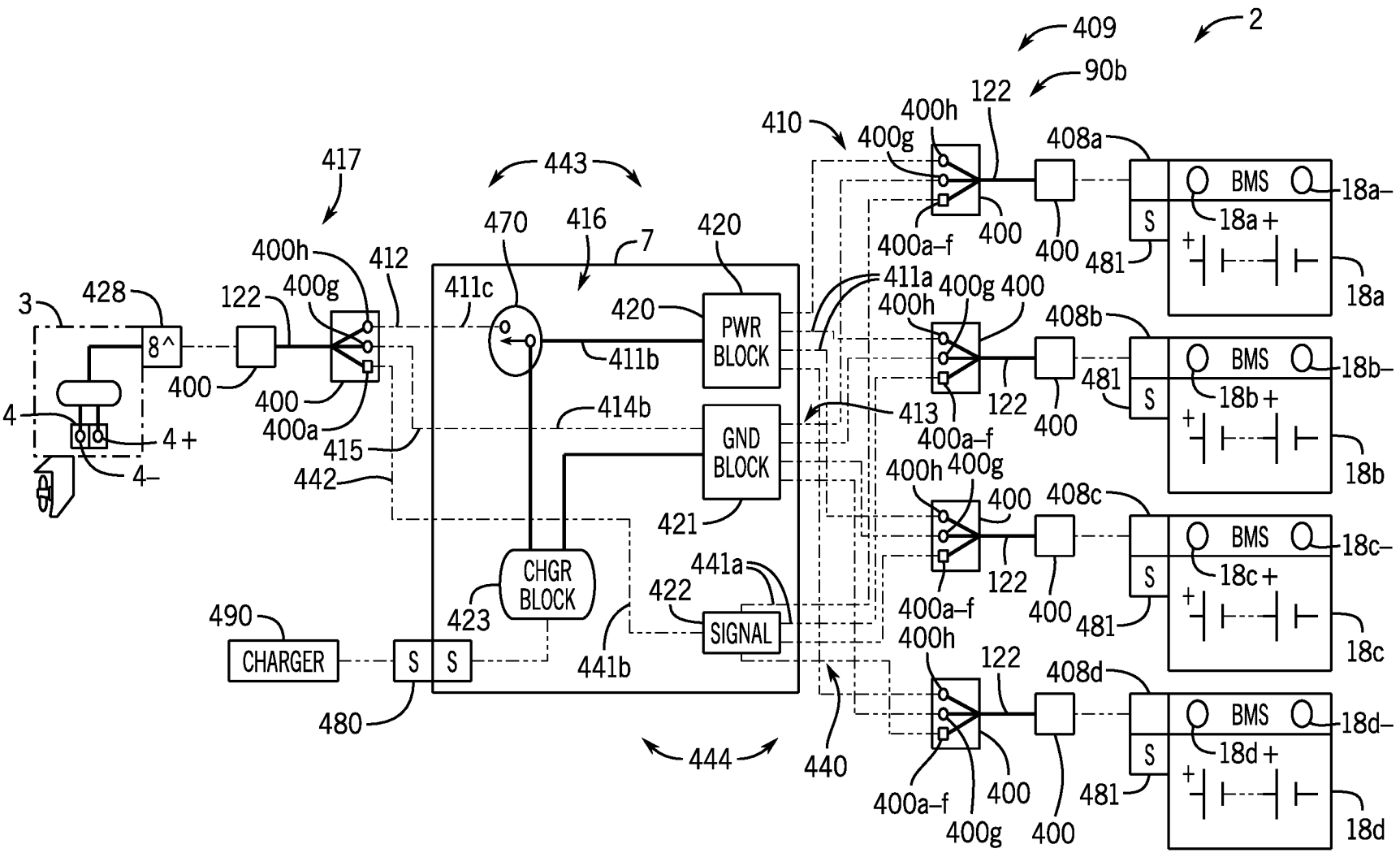
FIG. 20 is a schematic representation of another electric marine propulsion system according to the present disclosure, in which a power circuit and a signal circuit are illustrated.

FIG. 20 graphically depicts the power and signal connections of one embodiment of the propulsion system 2 having four marine batteries 18*a-d* connected in parallel to a switch box 7, which in turn connects to the marine drive 3. Four connection cables 90*a* connect each battery 18*a-d* to the switch box 7 and one connection cable 90*d* connects between the switch box 7 and the marine drive 3. The connection cables 90*d* and 90*b* each comprise a cable 122 having a connector 400 on each end, wherein the connector 400 is a unified power and signal connector, such as the elbow connector 100 or the straight connector 99 described above. In this example, each of the connection cables 90*b* and connection cable 90*d* have the same connector 400 arrangement and thus are all interchangeable. For example, the connectors 400 at the switch box end of the cables 90*b,d* may each be straight connectors 99 and the connectors 400 at the drive end of the cables 90*b,d* may each be elbow connectors 100. In an alternative example, all connectors at both ends of the cables may be straight connectors 99 or may be elbow connectors 100. In such an embodiment where the connectors 400 at both ends are identical, the cables 90*b,d* are reversible (direction agnostic) and interchangeable. In still other embodiments, the connectors 400 at different locations on the connection cables 90*b,d* may differ from one another, taking on any of the various embodiments described herein.

The unified power and signal connector 400 may have a pin, or terminal, arrangement similar to that shown and described with respect to FIGS. 5-6. The connector includes power terminals 400*g-h* (e.g., power pins 110*g-h* in FIGS. 5-6) and one or more signal terminals 400*a-f* (e.g., electrical pins 110*a-f* in FIGS. 5-6). The power terminals 400*g-h* connect a power circuit 443, where when connected, current flows from each of the batteries 18*a-d* to the marine drive 3 through the switch box 7. The signal terminals 400*a-f* connect to signal circuit 444. The signal terminals 400*a-f* include at least two interlock circuit terminals (e.g., electrical pins 110*a-b* ore pins 110*c-d* in FIGS. 5-6). The power circuit 443, signal circuit 444, and the interlock circuit 500 are described in detail below.

Figure 21:
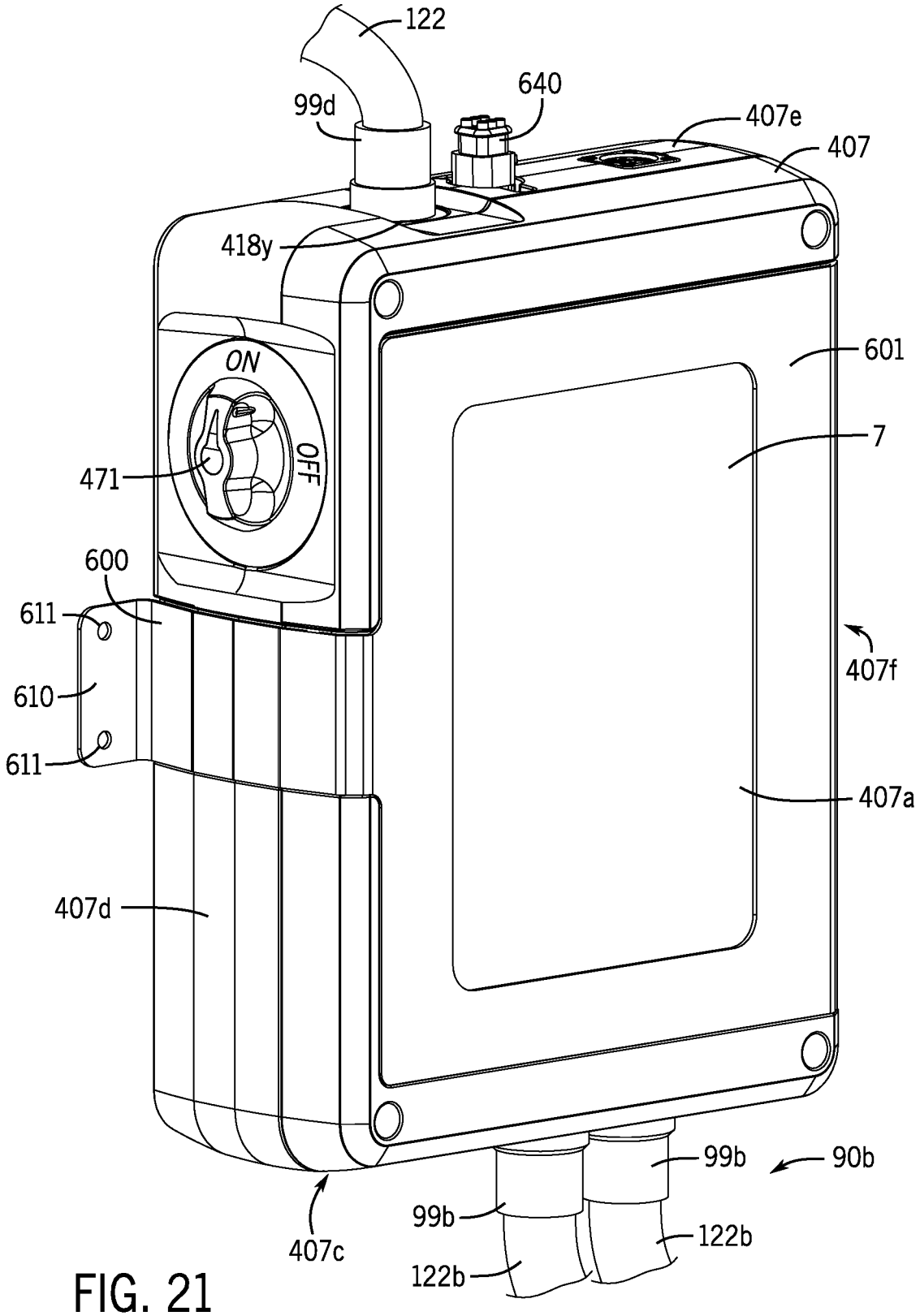
FIGS. 21-23 are exterior views of an exemplary switch box for a marine device of the electric marine propulsion systems of the present disclosure.
Figure 22:
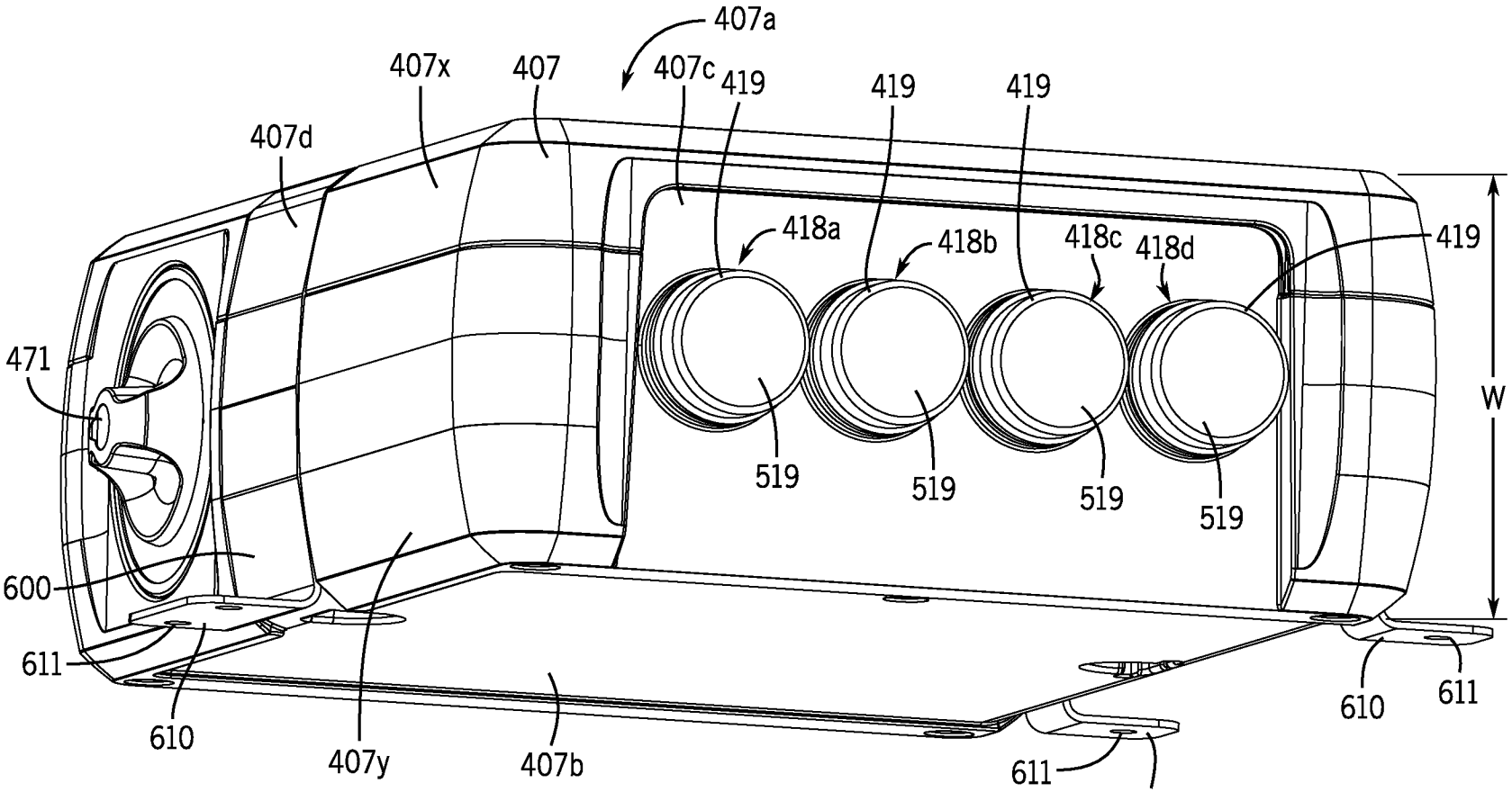
Figure 23:
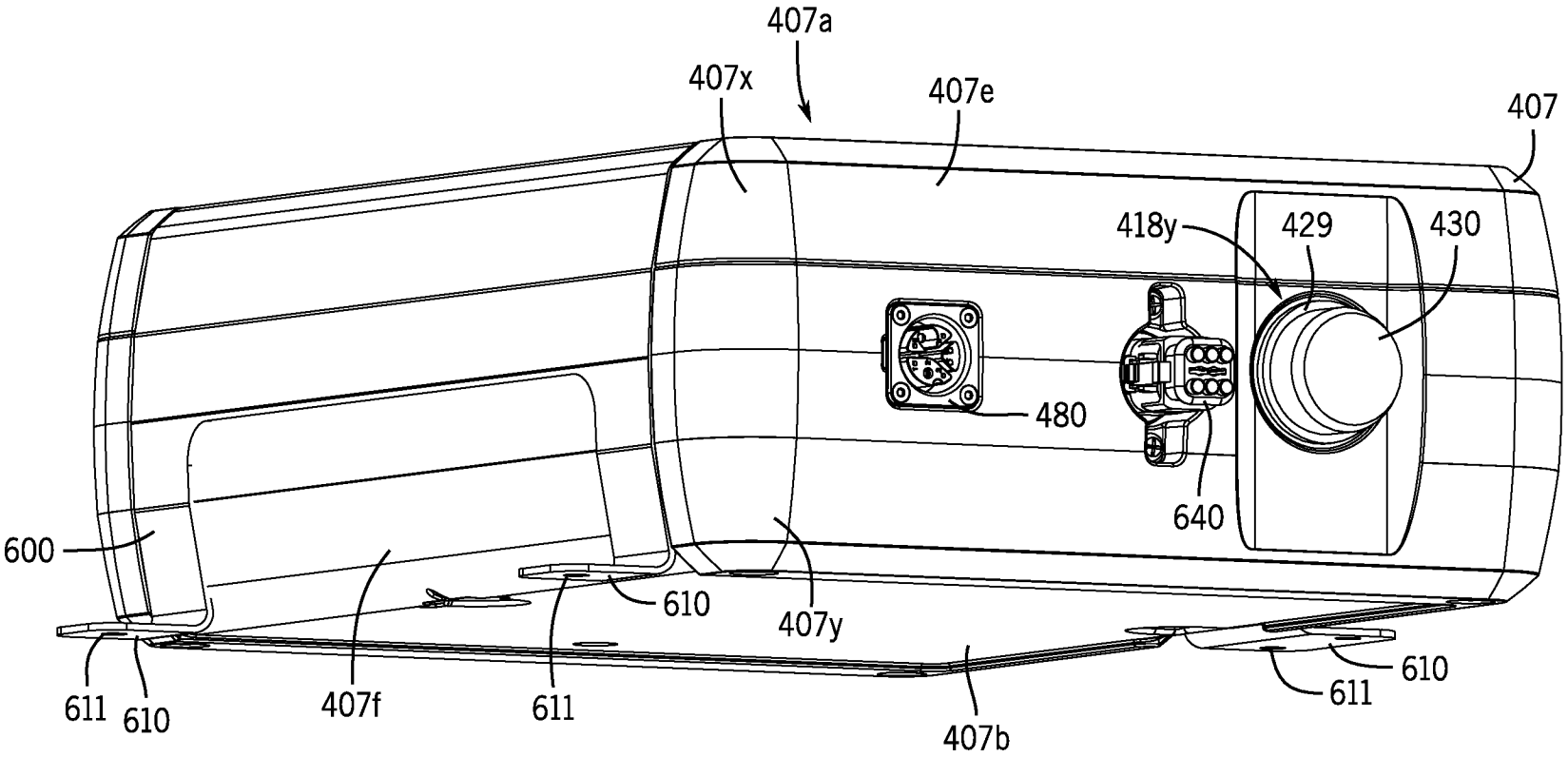

Each connection cable 90*b* connects between a respective battery port 408*a-d* on each marine battery 18*a-d* and switch box port 418*a-d* on the switch box 7. For example, each of the battery ports 408*a-d* may be formed by mating connectors 300 on the battery housing 18 as shown in FIG. 18. FIGS. 21-23 and 26-27 depict an exemplary embodiment of the switch box 7. FIG. 21 shows the switch box 7 with housing 407 connected to two connection cables 90*b* each having a straight connector 99*b* at the switch-box-end of the cable 122*b*. Referring in particular to FIGS. 21-23, each of the switch box ports 418*a-d* may be formed by mating connectors 419 having receptacles 519 on the switch box housing 407 configured to receive the mating end of each connector 400. For example, the mating connectors 419, being configured to provide electrical sockets for power and data connections (and in some embodiments interlock circuit connections or other safety control connections), may be the same or similar to the connectors 200, 300 having the same or similar receptacles as described above.

In the depicted example, the housing 407 is a rectangular-box-shape having a first side 407*a* and a second side 407*b*. Though the first side 407*a* is shown on top and the second side 407*b* is shown on bottom, the switch box housing 407 is configured to be mounted at any possible orientation such that any of the sides 407*a-f* are oriented upwards. The housing 407 has a third side 407*c*, fourth side 407*d*, fifth side 407*e*, and sixth side 407*f*. Here, the connection ports and other features are located on the sides 407*c-f*. As best shown in FIG. 22, switch box ports 418*a-d* are located together on one side, here the third side 407*c*. Four switch box ports 418*a-d* are shown, but in other embodiments a different number of switch box ports 418 may be provided, such as two ports, three ports, five ports, six ports, etc. In other embodiments, the switch box ports 418*a-d* may be distributed around the sides 407*c-f* of the housing 407, or even on the first or second sides 407*a-b*. The switch box ports 418*a-d* are centered along the width w of the housing 407 to provide symmetry, optimizing the switch box 7 design to be mounted or placed in any orientation on the vessel. The housing 407 comprises two pieces 407*x* and 407*y* that are connected together as described below with respect to FIG. 27.

Referring again to FIGS. 20 and 21, connection cable 90*d* connects between the switch box 7 and the marine drive 3, and more specifically between the drive port 428 and a switch box port 418 (e.g., dedicated port 418*y*) on the switch box housing 407. The drive port 428 may be on the outer housing, or cowling 50, of the marine drive 3, such as formed by the mating connector 200 shown in FIGS. 14 and 15 above. The other connector 400 of the cable 90*d* connects to the switch box 7. This is illustrated in FIGS. 21 and 23 as a straight connector 99*d* of switch box port 418*y*. FIG. 23 shows the corresponding side 407*e* of the switch box housing 407, where switch box port 418*y* is positioned (again centered in the width as described above). Thus, the switch box port 418*y* dedicated for connection to the marine drive 7 is on an opposing side 407*e* from the side 407*c* where the switch box ports 418*a-d* are located.

Figure 24:
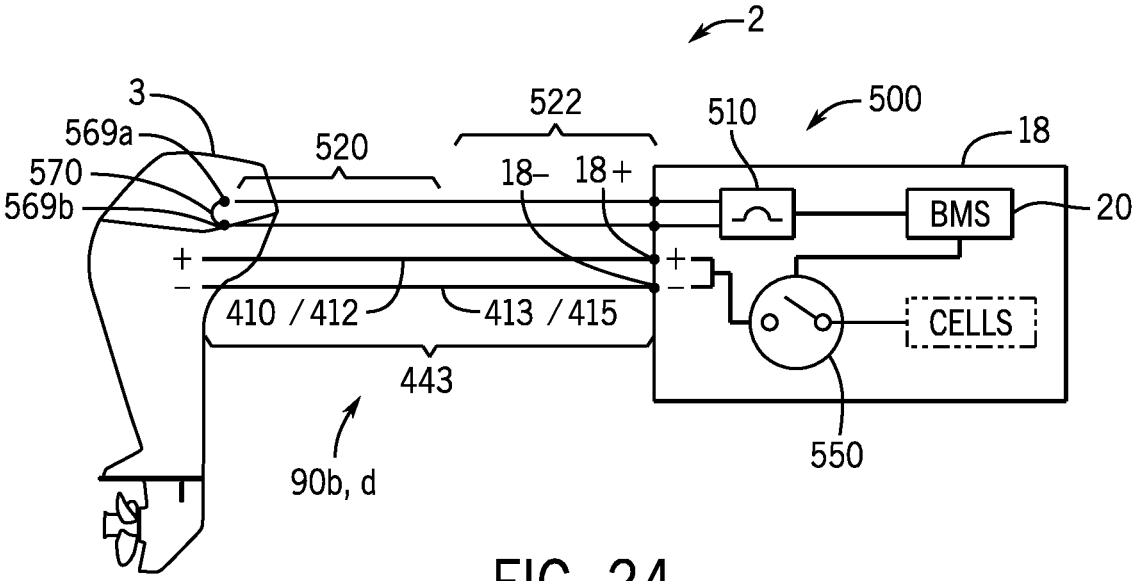
FIGS. 24-25 are schematic representations of another electric marine propulsion system according to the present disclosure, in which a power circuit and an interlock circuit are illustrated.

The switch box port 418*y* is formed by mating connector 429 having receptacle 430. The mating connector 429 is configured to receive and mate with connector 400 on the cable 90*d*, which in this embodiment is shown as straight connector 99*d*. The mating connector 429, being configured to provide electrical sockets for power and data connections (and in some embodiments interlock circuit connections or other safety control connections), may be the same or similar to the connectors 200, 300 having the same or similar receptacles as described above. Likewise, the mating connector 429 may be identical to the mating connectors 419 configured to connect to the batteries, thereby facilitating the use of identical connectors 400 and interchangeable connection cables 90*d* and 90*b* and the ability to use either of the cables 90*d* or 90*b* to connect the marine drive 3 directly to one of the batteries 18*a*-18*d*. This arrangement of one drive connected by connection cable 90*b,d* is schematically shown in FIG. 24 and also the arrangement depicted in FIG. 4.

Figure 25:
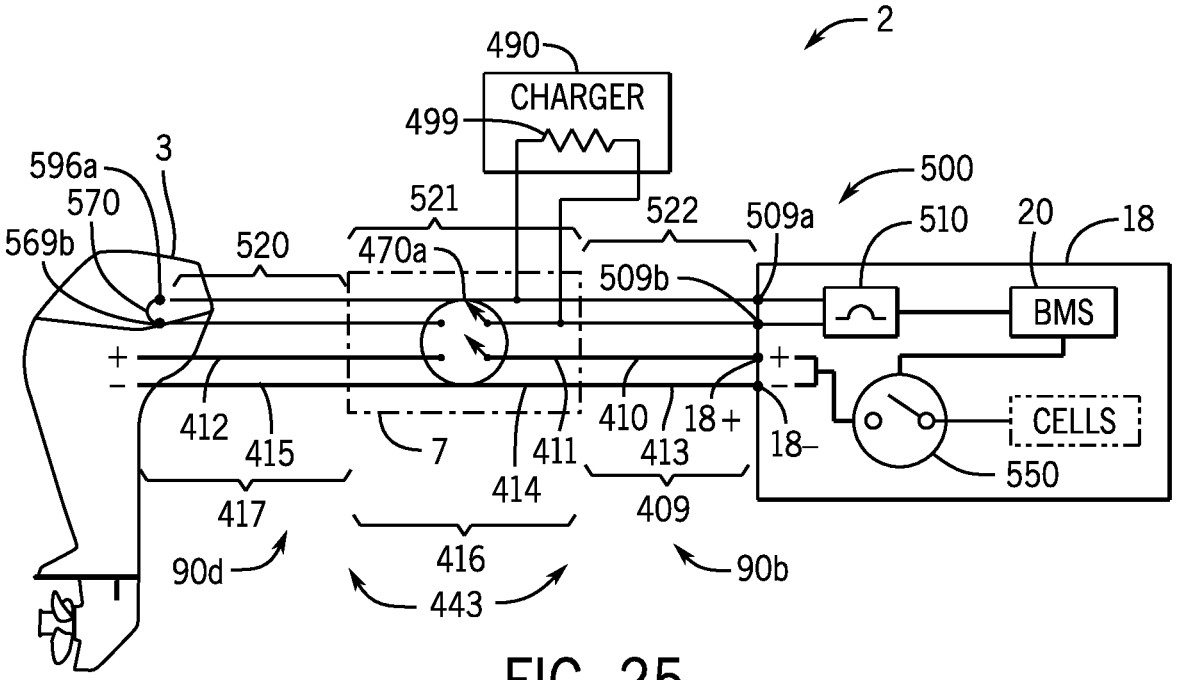

Referring again to FIG. 20, the switch box 7 and connection cables 90*b* and 90*d* enable completion of a power circuit 443 which delivers power and sufficiently high current levels from the one or more connected batteries 18*a*-18*d* to power the marine drive 3. In this example, the power circuit 443 includes a battery power circuit portion 409, a drive power circuit portion 417, and a switch box power circuit portion 416 connecting therebetween. As also shown in FIG. 25, the battery power circuit portion 409 includes sets of positive power connection legs 410 and ground power connection legs 413 (one set housed in each connection cable 90*b*) between each marine battery 18*a-d* and the switch box 7. More specifically, each positive power connection leg 410 connects from one of the positive battery terminals 18*a*+ through 18*d*+ to a positive power pin in a respective switch box port 418*a-d* and each ground/negative power connection leg 413 connects from one of the negative battery terminals 18*a*– through 18*d*– to a ground power pin in the respective switch box port 418*a-d*. The drive power circuit portion 417 includes a positive power connection leg 412 and a ground power connection leg 415 connecting between sets of positive power pins and between sets of negative power pins, respectively, on the switch box ports and drive ports (and ultimately to the positive power input 4+ and the negative power input 4– to the motor 4).

Where switch box 7 is included to connect a plurality of batteries 18*a-d*, the switch box 7 houses the switch box power circuit portion 416 that connects the drive power circuit portion 417 and the battery power circuit portion 409. However, as explained above, the system is configured to also enable direct connection of a marine drive 3 to a single battery 18. Also referencing FIG. 24, where the switch box is eliminated, the power circuit 443 includes overlapping power and drive circuit portions, where one cable 90*b,d* connects the positive and negative pins on the drive 3 (and ultimately the positive and negative inputs 4+ and 4– on the motor 4) to the positive and negative battery terminal 18+ and 18–, respectively.

Returning to FIGS. 20 and 25, the switch box power circuit portion 416 includes a positive power connection 411 and a ground power connection 414. The positive power connection 411 in the switch box 7 connects between the plurality of positive power connection legs 410 and the positive power connection leg 412. The plurality of plurality of positive power connection legs 410 are joined together within the switch box 7, electrically connected at power block 420. Power block 420 electrically connects to each of the positive power connection terminals 400*h* (when connector 400 is plugged into the respective port 418*a-d*) leading from the plurality of batteries 18*a-d* into one positive power connection output.

Figure 26:
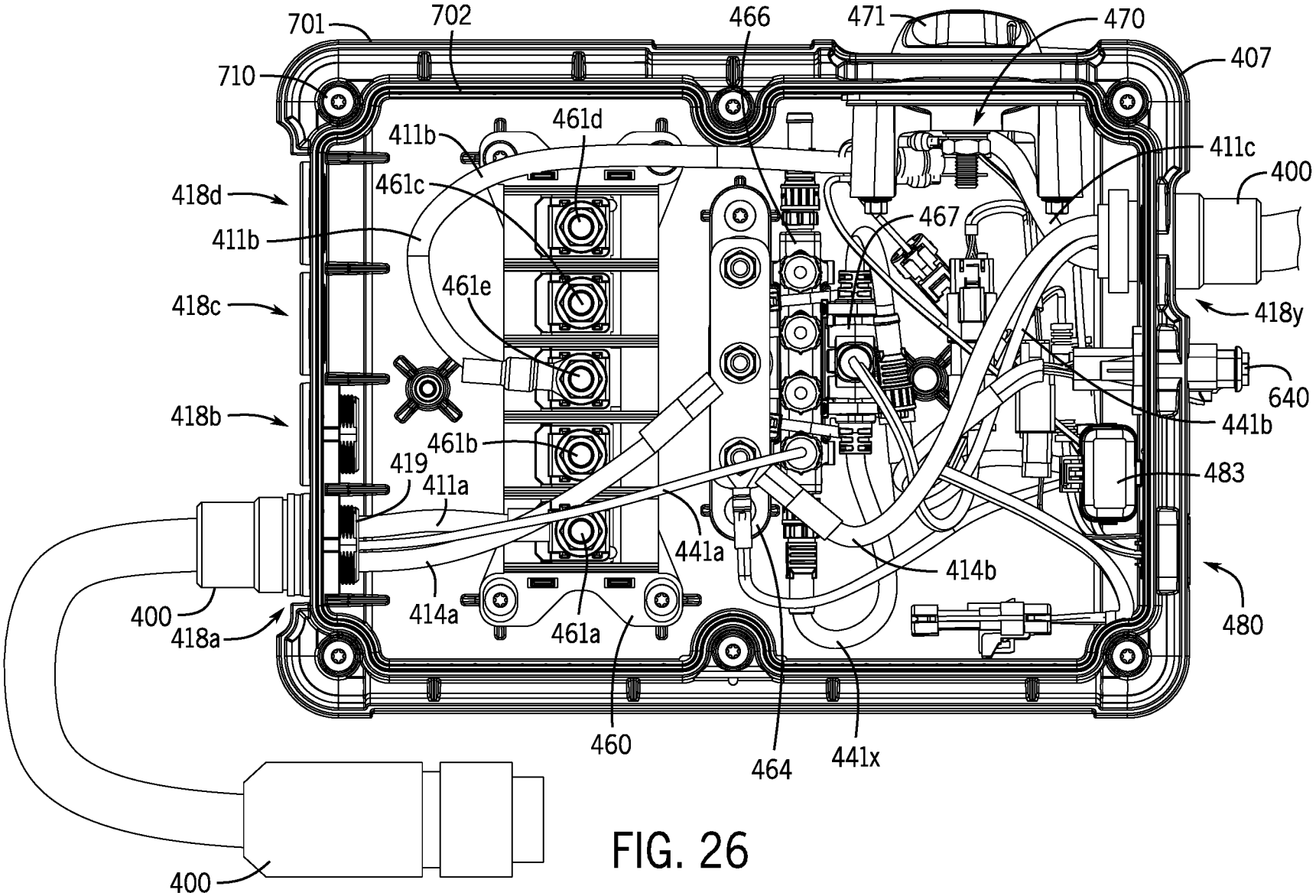
FIGS. 26-27 are is are interior views of an exemplary switch box for a marine device of the electric marine propulsion systems of the present disclosure.

Referring also to FIG. 26, an interior view of the switch box 7 is shown with the first cover piece 407*x* removed. As shown here, the power block 420 includes a fuse bus 460 that includes a bus bar with a fuse connecting to each switch box port 418, including each port 418*a-d* providing a battery connection and each port 418*y* providing a drive connection. Thus, in this example where the switch box 7 is configured to provide parallel connections for up to four batteries 18*a-d*, the fuse bus includes five fuses 461*a-e*. Fuses 461*a-d* each connect to the positive power input from batteries 18*a-d* through switch box ports 418*a-d*. For visual clarity, FIG. 26 shows connection of only one connector, connector 419*a* of port 418*a*, which is connected to the fuse bus 460 via positive power connection portion 411*a*. Each remaining port 418*b-d* has a mating connector identical to connector 419*a* (not shown for visual clarity) that connects to a respective fuse 461*b-d* on the fuse bus 460. A fifth fuse 461 connects to output switch box port 418*y* via providing the output connection to the marine drive 3 via positive power connection portions 411*b* and 411*c*. As explained further below, positive power connection portions 411*b* and 411*c* are connected/disconnected by a user-operated switch 470.

The ground power connection 414 in the switch box 7 connects the plurality of ground power connection legs 413 to the ground power connection leg 415 via ground block 421. Ground block 421 includes ground bus bar 464 that electrically connects each of the ground terminals 400*g* (when connector 400 is plugged into the respective port 418*a-d*) together to one ground output to the dedicated drive port 418*y*. Again, only one connector is shown for visual clarity, connector 419*a* of port 418*a*, which is connected to the ground bus bar 464 via ground power connection portion 414*a*. Each remaining port 418*b-d* is also connected to the ground bus bar 464, which in turn connects to ground power connection portion 414*b* leading to switch box port 418*y*.

A user-operable switch 470 is positioned in the positive power connection 411, positive power connection portions 411*b* and 411*c* to enable a user to disconnect the power circuit 443. For example, the user-operable switch 470 is a switch configured to provide a central connection/disconnection point for the power circuit 443 (and also, as explained more below, the interlock circuit). In the depicted embodiment, the user-operable switch 470 is a two-position rotary switch having a knob 471 on the exterior of the housing 407 movable by a user between an "ON" position and an "OFF" position (see FIG. 21). In other embodiments, the user-operable switch 470 may be a different type of switch mechanism, such as a button, a slider, etc.

Referring again to FIG. 20, the switch box 7 enables a central location for charging all of the connected marine batteries 18*a-d*. Charging port 480 in the switch box housing 407 is configured to receive a battery charger connector, such as a battery charger 490 connected to 120V AC grid power, or any standard shore power or wall power supply. The charging port 480 is connected to the charger block 423. Referring also to FIG. 26, the charger block 423 includes fuse block 483 providing fuses for isolation of the charger. For example, smaller fuses (e.g., 30 amp fuses) may be provided in fuse block 483, which reduces the number of fuses needed to be included in the marine-grade charger device, thereby reducing bulk and cost of the marine-grade charger. Each battery 18*a-d* also has a charging port 481 (see FIGS. 18 and 20) configured to receive the same battery charger connector such that the charger 490 can connect directly to any of the batteries 18*a-d*. As shown in described in more detail below with respect to the interlock circuit, the system 2 is configured such that the user-operable switch 470 must be open (in the "OFF" position) for charging current to be delivered to the batteries 18*a-d*.

As shown in FIGS. 21-23, the switch box 7 may include a bracket 600 configured to enable mounting the switch box 7 at any location on the marine vessel, such as under a seat, on a floor surface of the vessel 1 (as shown in FIG. 1), on a sidewall surface of the vessel 1, etc. The bracket 600 includes a plurality of flanges 610 with holes 611 configured to be screwed or otherwise fastened to a surface. The bracket 600 is configured to securely hold the housing 407 in place, covering at least a portion of three sides 407*a,d,f* thereof. In some embodiments, the bracket 600 and housing 407 may be configured such that the housing 407 can be oriented in either direction in the bracket 600 (i.e., the planar side 601 can contact the first side 407*a* or the second side 407*b*) to allow maximum flexibility for mounting the switch box 7. Alternatively, the switch box 7 may simply be set in the vessel during use and may be carried on and off the vessel 1 with each use. In some embodiments, the housing 407 or the bracket 600 may be configured with a handle to facilitate easy carrying.

Referring again to FIG. 20, signal circuit 444 communicates data between the battery controllers 20*a-d* and the central controller 12, such as configured as a CAN bus connection. Signal circuit 444 also includes the interlock circuit, as described in more detail below. Signal circuit 444 is formed by signal connection legs 440 connecting between each of the batteries 18*a-d*, signal connection leg 441*a-b* in the switch box, and signal connection leg 442 connecting to the marine drive 3. Each of signal connection legs 440 and 442 is housed in a respective connection cable 90*b,d*, which as described above is a multi-wire and multi-pin connection for power and signal (data and interlock). The switch box 7 houses signal connection leg 441*a-b* between each of the switch box ports 418*a-d* and switch box port 418*y*. Signal connection portion 441*a* connects between connector 419*a* of port 418*a* (again, only one connector is shown for visual clarity) and signal block 422, thus connecting each of the signal terminals 400*a-f* (when connector 400 is plugged into the respective switch box port 418*a-d*) to a junction point. Referring also to FIG. 26, signal block 422 includes a CAN bus junction 466 and a breakout connection 467. CAN bus junction 466 is a six-way junction that connects data communication wires (e.g., CAN high, CAN low, CAN ground/reference) and two interlock circuit wires, as well as a shield wire into an output 441*x* that connects to the breakout connection 467. The breakout connection 467 splits the two interlock circuit wires to connect the interlock circuit 500 (see FIG. 25) to the user-operable switch 470 and the charger port harness, as well as to an auxiliary port 640.

As best shown in FIGS. 21, 23, and 26, the switch box 7 may also include an auxiliary port 640 providing an interface connector for connecting low voltage auxiliary items, such as depth monitors, fish finders, and other electronic devices. The auxiliary port 640 may be configured to deliver a 12 V current to connected devices, and in some embodiments may be configured with one or more communication pins, such as configured to communicate on the signal bus (e.g., CAN bus) of the signal circuit. In some embodiments, auxiliary port 640 may also be configured to provide a common ground for multi-drive arrangements. Alternatively or additionally, the auxiliary port 640 may be configured to provide a connecting to corrosion and bonding busses.

Figure 27:
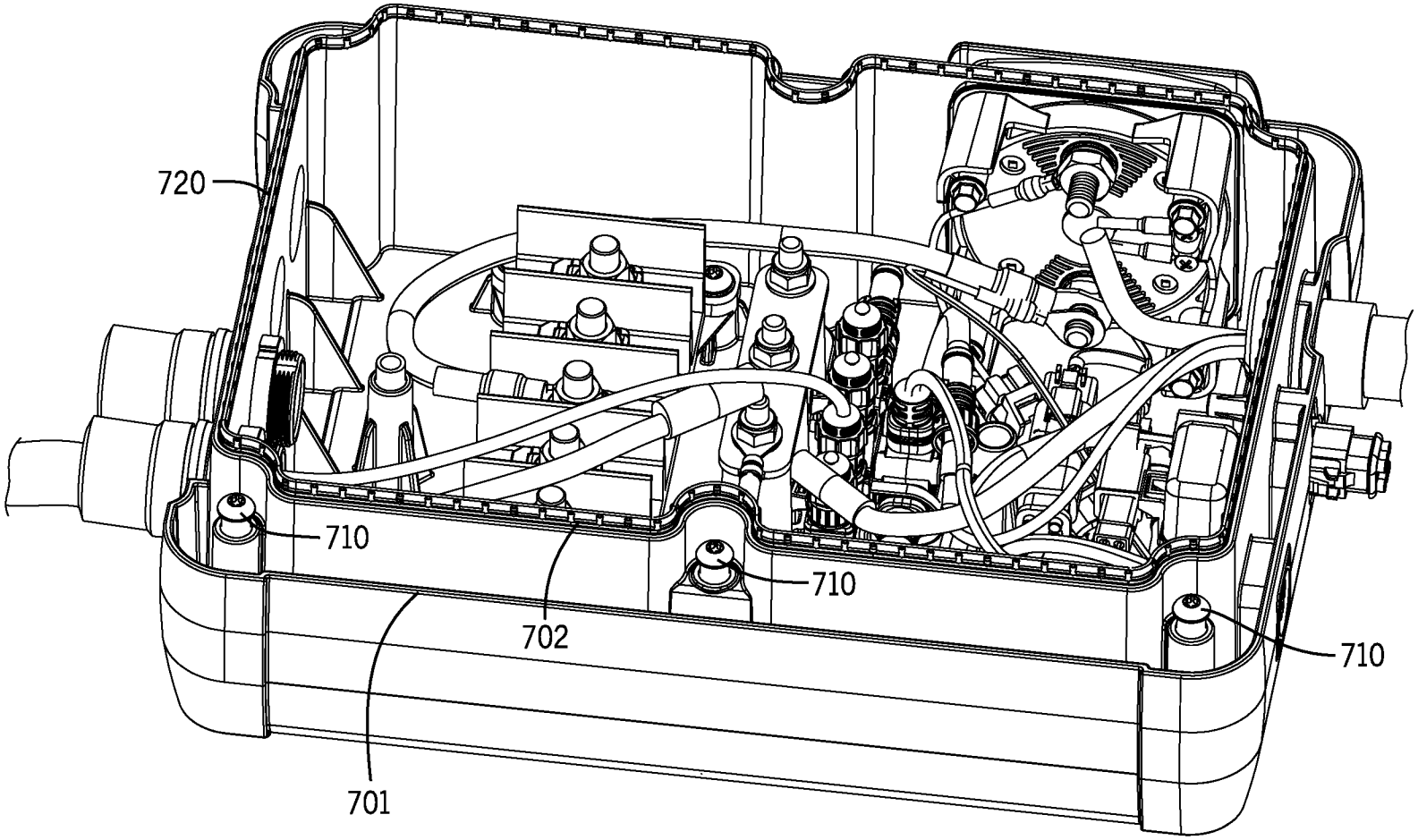

The housing 407 is water-tight and configured to withstand marine environments, and also to provide protection and shock absorption for the electrical elements encapsulated therein. As shown in FIGS. 26 and 27, the housing 407 is double-walled, having an outer wall 701 and an inner wall 702 to provide protection and an attractive outer appearance. The housing 407 is formed by connecting two pieces 407*x* and 407*y*, each being double-walled pieces, that are connected by six screws 710. The deeper piece 407*y* is shown in FIGS. 26 and 27 with the shallower piece 407*x* removed. Along the inner wall 702 between the two pieces 407*x* and 407*y* is a gasket 720 to discourage water ingress through the joint between the two pieces.

The system 2 may include an interlock circuit 500 configured to provide a control signal by which the marine batteries 18*a-d* can determine an appropriate mode between a power delivery mode, a charge mode, and a disconnected mode and operate an internal disconnect accordingly. The interlock circuit 500 is configured to provide a completed circuit when the at least one battery 18 and the marine drive 3 are connected via connection cable(s) 90*b,d* (directly or through the switch box 7). FIGS. 24 and 25 depict an exemplary interlock circuit 500 that is adaptable to accommodate a direct connection to a single battery (FIG. 24) or a connection through the switch box 7 (FIG. 25) to enable connection and disconnection of any number of one or more marine batteries 18. The interlock circuit 500 runs parallel to but is independent from the power circuit 443 such that circuits 500 and 443 are not electrically connected. Accordingly, interlock circuit portions run through the connection cable(s) 90*b,d* incorporated in the system 2. The interlock circuit 500 is configured for lower current than the power circuit 443—e.g., with a lower gauge wire than that of the power circuit 443 which carries a much higher current to power the motor 4.

Each battery controller 20 is configured to measure a resistance of the interlock circuit 500 across the receiving terminals 509*a-b* at the battery port (e.g., 408*a-d* in FIGS. 20 and/or 300 in FIGS. 18-19). The receiving terminals 509*a-b* connect to the two interlock circuit terminals 400*a-b* in the connection cable 90*b* connecting to the battery 18, whether directly or through a switch box 7. A resistance measurement unit 510 measures a resistance across the receiving terminals 509*a-b* and communicates the value to the battery controller 20. For example, resistance measurement unit 510 may be an interlock detection circuit configured to inject a small current into the interlock circuit 500 at a known voltage, and measuring the voltage drop across the interlock sockets 781*c-d* and 788*c-d* so as to determine the resistance. The battery controller 20 is configured to perform comparison logic comparing the resistance to one or more thresholds to identify which operation mode—power delivery mode, charge mode, or disconnected mode—is appropriate.

The interlock circuit 500 includes a drive circuit portion 520 and battery circuit portion 522. The battery circuit portion 522 connects to the battery port (e.g., 408*a-d* in FIGS. 20 and/or 300 in FIGS. 18-19), including the receiving terminals 509*a-b*. The drive circuit portion 520 connects to the drive port (e.g., 428 in FIGS. 20 and/or 200 in FIGS. 14-15) on the marine drive 3, including the receiving terminals 569*a-b*. In the depicted embodiment, the drive circuit portion 520 of the interlock circuit 500 terminates in a short 570 between the receiving terminals 569*a-b* in the drive port. Thus, when the connection cable 90*d* is connected to the drive port, the drive circuit portion 520 is shorted and adds little to no resistance to the interlock circuit 500. In other embodiments, a resistor of a known fixed resistance may separate the receiving terminals 569*a-b* at the drive end.

Based on a low measured resistance (or the appropriate known fixed resistance at the drive end) of the interlock circuit 500 by the resistance measurement unit 510, the battery controller 20 determines that the battery 18 and the marine drive 3 are connected together and engages a power delivery mode by controlling the internal disconnect 550 to connect to the power circuit 443—namely, to connect the power storing battery cell(s) to the output terminals 18+, 18–. On the other hand, if the resistance of the interlock circuit 500 is significantly higher (e.g., orders of magnitude greater or more) then the controller determines that the interlock circuit 500 is open, such as because the marine drive 3 and/or the battery 18 are not connected. When the interlock circuit 500 is open, the battery controller 20 engages the disconnected mode where the internal disconnect 550 disconnects the battery cells from the terminals 18+, 18– thereby removing the battery from the power circuit 443.

When the system 2 includes a switch box 7, the interlock circuit 500 includes a switch box circuit portion 521 that connects between the drive circuit portion 520 and the battery circuit portion 522. As shown in FIG. 25, the switch box circuit portion 521 routes through the switch 470*a*, which here is a switch configured to simultaneously disconnect both the power circuit 443 and the interlock circuit 500. When the switch 470*a* is opened, the resistance sensed at the battery end by the resistance measurement unit 510 becomes very high because it is sensing resistance across the open circuit. Based on the sudden drastic change in resistance on the interlock circuit 500, the battery controller 20 knows that the switch 470*a* has been opened. It then switches to the disconnected mode to disconnect from the power circuit 443.

The interlock circuit 500 may also be configured to enable multi-battery charging though the switch box 7. The battery charger 490 may be configured to connect to the interlock circuit 500 such that its connection to the charging port 480 (see FIGS. 20 and 26) can be detected by the battery 18 (or all connected batteries 18*a-d*) to enable charging. Thus, the battery charger has a connector (not shown) configured with pins for the interlock circuit and the charging port 480 has interlock circuit receptacles, similar to the connectors described above. Here, the charger 490 is configured to connect a predefined charge indicator resistance 499 to the interlock circuit 500, and specifically to the battery circuit portion 522 between the battery 18 and the switch box 7. For example, the charge indicator resistance may be a relatively large resistance value, such as 5 kOhms. Thereby, when the switch 470*a* is open, the resistance of the interlock circuit 500 measured by the resistance measurement unit 510 is close to or within a range of the predefined charge indicator resistance 499. The battery controller 20 then switches the battery to charge mode enabling the battery 18 to receive a charge current via terminals 18+, 18–. However, when the switch 470*a* is closed and the interlock circuit 500 is completed between the battery 18 and the drive 3, then the resistance measured by the resistance measurement unit 510 will be low because current will travel the path of least resistance through the short 570. Thus, the battery controller 20 will remain in power delivery mode and will not enable charging even if the battery charger 490 is connected.

Figure 28:
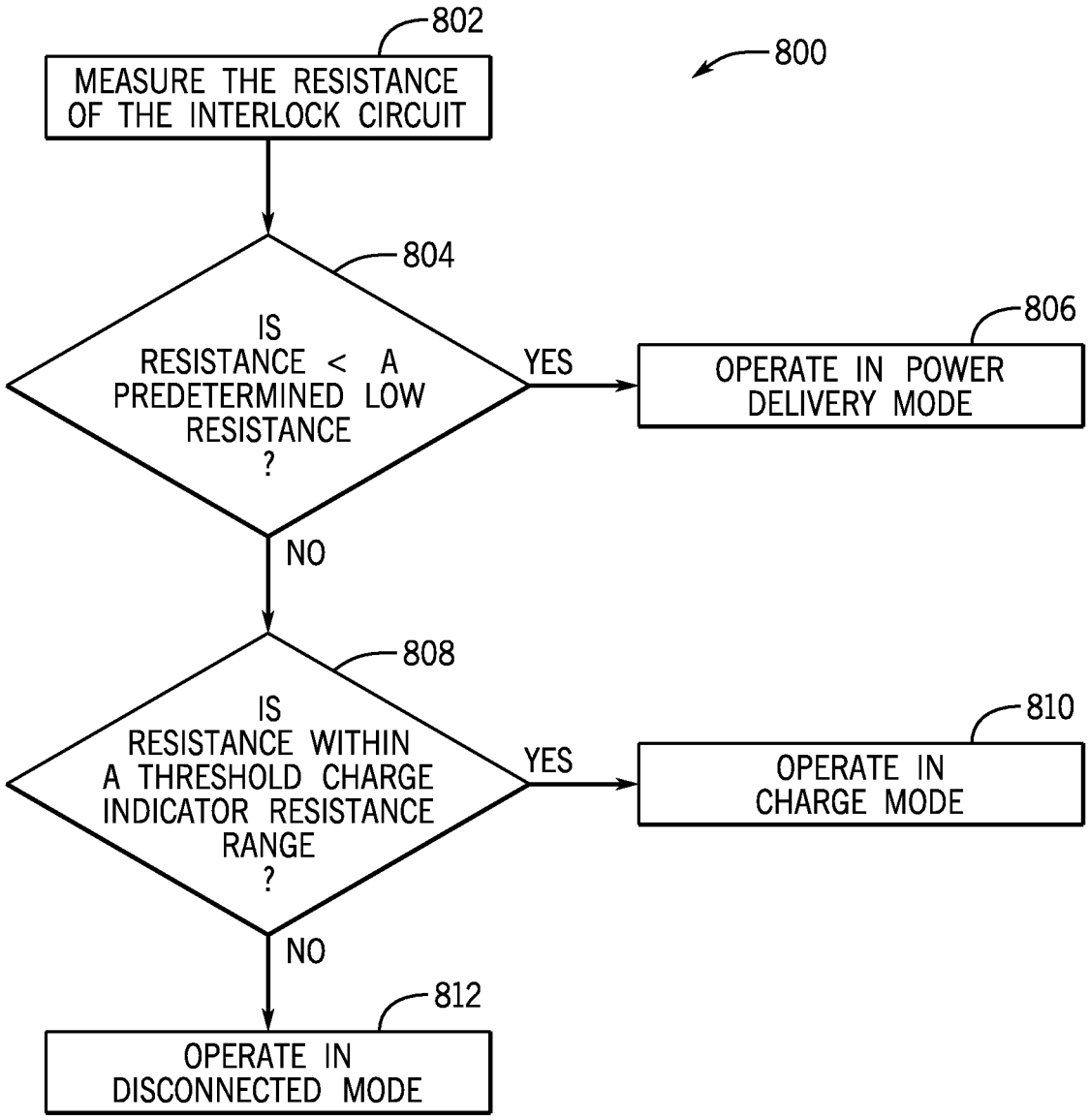
FIG. 28 is a flow chart illustrating one embodiment of a method of controlling a power circuit of an electric marine propulsion system according to the present disclosure.

FIG. 28 depicts one embodiment of a method 800 of controlling a power circuit for an electric marine propulsion system 2, and particularly for controlling connection of one or more batteries to the power circuit 443 with an interlock circuit 500. The resistance of the interlock circuit 500 is measured at step 802, such as by the resistance measurement unit 510 in the battery 18. The resistance is provided to the battery controller 20 which conducts the following comparative logic. If the resistance is less than a predetermined low resistance at step 804, then the battery is operated in the power delivery mode (shown as step 806). For example, the predetermined low resistance may be set based on the expected resistance of the completed interlock circuit 500 when both the marine drive 3 and the battery 18 are connected, allowing for a buffer. Additionally, the predetermined low resistance may be sufficiently below the low end of the threshold charge indicator resistance range such that fluctuations in resistance or measurement error will not erroneously trigger operation in the power delivery mode. To provide one example where the drive end of the interlock circuit 500 is a short 570 or low resistance and the predefined charge indicator resistance 499 is 5 kOhms, the predetermined low resistance may be 500 Ohms. Thus, if the resistance measurement unit 510 measures anything less than 500 Ohms then the battery controller operates in the power delivery mode.

If the measured resistance is not less than the predetermined low resistance at step 804, then step 808 is executed to determine whether the resistance is within a threshold charge indicator resistance range. If so, then the controller 20 operates the battery 18 in the charge mode at step 810 enabling receipt of charge current from a battery charger 490. The threshold charge indicator resistance range is a threshold range of resistances that includes the predefined charge indicator resistance 499. Thus, if the battery charger 490 connects to the charging port 480 of the switch box 7 and is configured to connect a predefined charge indicator resistance 499 to the interlock circuit 500, and the drive circuit portion 520 is disconnected, then the measured resistance by the resistance measurement unit 510 will be within range of the predefined charge indicator resistance 499 and the charge mode is triggered. To provide one example where the predefined charge indicator resistance 499 is 5 kOhms, the threshold charge indicator resistance range may be 4 kOhms to 6 kOhms. Thus, if the resistance measurement unit 510 measures a resistance of the interlock circuit 500 that is within that range, then the battery controller operates in the charge mode.

If the resistance is not within the threshold charge indicator resistance range at step 808 (and not less than the predetermined low resistance as described above), then the battery controller 20 operates in the battery 18 in the disconnected mode at step 812 where the battery internal disconnect 550 is controlled to remove the battery 18 from the power circuit 443 such that power delivery from and power receipt to the battery cells are disabled. Thereby, the battery power is conserved, and shock hazards are reduced, when the marine drive 3 is not connected. In the example above, if the resistance measurement unit 510 measures a resistance of the interlock circuit 500 that is greater than 6 kOhms, then the battery controller operates the battery in the disconnected mode.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings and can include electrical couplings. "Electrical" couplings or connections can include, but are not limited to, power and signal connections.

In the present description, certain terms have been used for brevity, clarity, and understanding. No unnecessary limitations are to be implied therefrom beyond the requirement of the prior art because such terms are used for descriptive purposes only and are intended to be broadly construed. It is to be understood that the invention is not limited in its application to the details of construction and the arrangement of components set forth in the foregoing description or illustrated in the drawings. The invention is capable of other embodiments and of being practiced or of being carried out in various ways. The different assemblies described herein may be used alone or in combination with other systems. Various equivalents, alternatives, and modifications are possible within the scope of the appended claims. The methods herein are not limited to being performed in the order described and could be performed in any logical order.

We claim:

1. A marine propulsion system comprising:

a marine drive having an electric motor powerhead;

at least one marine battery;

at least a first connection cable having a connector configured to removably connect to a drive port on a housing of the marine drive to removably connect a power circuit delivering power from the at least one marine battery to the marine drive;

an interlock circuit configured to become a completed circuit when the at least one marine battery and the marine drive are connected via the at least the first connection cable, wherein the interlock circuit is not electrically connected to the power circuit delivering power from the at least one marine battery to the marine drive; and wherein the at least one marine battery is configured to identify whether the interlock circuit is completed and to control an internal disconnect to connect to the power circuit when the interlock circuit is completed and to disconnect from the power circuit when the interlock circuit is opened.

2. The system of claim 1, wherein the first connection cable is configured to removably connect between the drive port on the marine drive and a battery port on a housing of the at least one marine battery to connect the power circuit and the interlock circuit between the marine drive and the at least one marine battery.

3. The system of claim 1, wherein the connector includes two interlock circuit terminals and two power circuit terminals.

4. The system of claim 1, further comprising a switch box removably connectable to the marine drive and to each of at least two marine batteries; and wherein the interlock circuit is configured to provide the completed circuit when at least one of the at least two marine batteries and the marine drive are connected to the marine drive through the switch box.

5. The system of claim 4, wherein the switch box is configured to deliver power from each of the at least two marine batteries in parallel, and wherein a subset of the at least two marine batteries can be disconnected from the switch box without disconnecting the power circuit or opening the interlock circuit to the remaining marine batteries.

6. The system of claim 4, wherein the switch box comprises a user-controlled switch operable by a user to connect and disconnect the power circuit and/or the interlock circuit.

7. The system of claim 6, wherein the user-controlled switch is configured to connect and disconnect each of the power circuit and the interlock circuit, simultaneously.

8. The system of claim 4, further comprising at least three connection cables, wherein the first connection cable is configured to connect the power circuit and the interlock circuit from the switch box to the marine drive, and including a second connection cable configured to connect the power circuit and the interlock circuit from the switch box to a first battery of the at least two marine batteries and a third connection cable configured to connect the power circuit and the interlock circuit from the switch box to a second battery of the at least two marine batteries;

wherein each connection cable includes a first connector configured to connect to the switch box and a second connector configured to connect to one of the marine drive, the first battery, and the second battery.

9. The system of claim 8, wherein each connector includes two interlock circuit terminals and two power circuit terminals.

10. The system of claim 9, wherein each of the at least two marine batteries is configured to measure a resistance of the interlock circuit across the two interlock circuit terminals in the second connector connected thereto, and wherein identifying whether the interlock circuit is completed includes determining whether the resistance of the interlock circuit is less than a predetermined low resistance.

11. The system of claim 8, wherein each of the switch box and the at least two marine batteries is portable such that it is configured to be disconnected from the system by disconnecting each of the first connection cable, second connection cable, and third connection cable, and carried on and off of a marine vessel.

12. The system of claim 4, wherein the switch box is further configured to connect to a battery charger and to deliver a charge current to each of the at least two marine batteries when the battery charger is connected.

13. The system of claim 12, wherein the system further includes the battery charger configured to connect to the interlock circuit at the switch box and to connect a predefined charge indicator resistance to the interlock circuit; and wherein each of the at least two marine batteries is configured measure a resistance of the interlock circuit and, if the measured resistance is within a threshold range including the predefined charge indicator resistance, switch to a charging mode to receive the charge current from the battery charger.

14. The system of claim 1, wherein each of the at least one marine battery is configured to measure a resistance of the interlock circuit, and wherein identifying whether the interlock circuit is completed at the marine drive includes determining whether the resistance of the interlock circuit is less than a predetermined low resistance.

15. A power control system for controlling a power circuit of an electric marine propulsion system, wherein the power circuit delivers power from at least one marine battery to a marine drive, the power control system comprising:

an interlock circuit comprising:

a drive circuit portion connecting to the marine drive;

at least one marine battery circuit portion, each battery circuit portion connecting to a respective one of the at least one marine battery;

wherein the interlock circuit is configured to become a completed circuit that includes the drive circuit portion and the at least one marine battery circuit portion when the marine drive and the at least one marine battery are connected via at least one connection cable delivering the power from the at least one marine battery to the marine drive, wherein the interlock circuit is not electrically connected to the power circuit; and a battery controller in each of the at least one marine battery configured to identify whether the interlock circuit is completed and to control an internal disconnect to connect to the power circuit when the interlock circuit is completed and to disconnect from the power circuit when the interlock circuit is open.

16. The system of claim 15, wherein each of the at least one marine battery is configured to measure a resistance of the interlock circuit, and wherein each battery controller is configured to identify whether the interlock circuit is completed at the marine drive by determining whether the measured resistance of the interlock circuit is less than a predetermined low resistance.

17. The system of claim 15, wherein the interlock circuit is configured to enable connection of a plurality of battery circuit portions each connecting to one of a plurality of marine batteries, and to enable removal of a subset of the plurality of battery circuit portions without opening the interlock circuit for at least one remaining battery circuit portion in the plurality of battery circuit portions.

18. The system of claim 15, further comprising a switch box configured to complete the power circuit and the interlock circuit between each of a plurality of marine batteries in parallel and the marine drive so as to power the marine drive, wherein the switch box includes a user-controlled switch operable to simultaneously connect and disconnect the power circuit and the interlock circuit.

19. The system of claim 18, further comprising at least three connection cables, including a first connection cable containing the drive circuit portion and configured to connect the power circuit from the switch box to the marine drive, a plurality of battery connection cables each containing one of a plurality of battery circuit portions and configured to connect the power circuit from the switch box to a respective one of a plurality of marine batteries;

wherein each battery connection cable includes a first connector configured to connect to the switch box and a second connector configured to connect to a battery port on one of the plurality of marine batteries or on the marine drive; and wherein each connector includes two interlock circuit terminals and two power circuit terminals.

20. A method of controlling a power circuit of an electric marine propulsion system including at least one marine battery and a marine drive, the method comprising:

measuring a resistance of an interlock circuit, wherein the interlock circuit is configured to provide a completed circuit when the at least one marine battery and the marine drive are connected via at least one connection cable, wherein the interlock circuit is independent from a power circuit delivering power from the at least one marine battery to the marine drive; and controlling a mode of each battery between a power delivery mode, a charge mode, and a disconnected mode based on the measured resistance of the interlock circuit.

21. The method of claim 20, further comprising identifying whether the interlock circuit is completed based on the measured resistance; and if the interlock circuit is completed, connecting at least one marine battery to a power circuit in a power delivery mode enabling delivery of power from the at least one marine battery to a marine drive.

22. The method of claim 20, further comprising identifying whether the interlock circuit is completed at the marine drive by determining whether the measured resistance of the interlock circuit is less than a predetermined low resistance.

23. The method of claim 20, further comprising measuring the resistance of the interlock circuit at two interlock circuit terminals at each of the at least one marine battery.

24. The method of claim 20, further comprising:

if the measured resistance of the interlock circuit is less than a predetermined low resistance, operating the battery in the power delivery mode enabling power delivery to the marine drive;

if the measured resistance of the interlock circuit is within a threshold charge indicator resistance range, operating the battery in the charge mode enabling power receipt from a charger;

if the measured resistance is not less than the predetermined low resistance and not within the threshold charge indicator resistance range, operating the battery in the disconnected mode where power delivery and power receipt are disabled.

* * * * *